US009718279B2

(12) United States Patent
Ehara

(10) Patent No.: US 9,718,279 B2
(45) Date of Patent: Aug. 1, 2017

(54) LABEL MEDIUM AND LABEL MANUFACTURING APPARATUS

(71) Applicant: MAX CO., LTD., Tokyo (JP)

(72) Inventor: Takayuki Ehara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 117 days.

(21) Appl. No.: 14/489,767

(22) Filed: Sep. 18, 2014

(65) Prior Publication Data

US 2015/0086742 A1 Mar. 26, 2015

(30) Foreign Application Priority Data

Sep. 20, 2013 (JP) ..... 2013-195374

(51) Int. Cl.

| | |
|---|---|
| ***G09F 3/02*** | (2006.01) |
| ***B41J 3/407*** | (2006.01) |
| ***B41J 11/66*** | (2006.01) |
| ***B41J 11/70*** | (2006.01) |

(52) U.S. Cl.

CPC ..... *B41J 3/4075* (2013.01); *B41J 11/663* (2013.01); *B41J 11/703* (2013.01); *Y10T 428/1476* (2015.01)

(58) Field of Classification Search

None

See application file for complete search history.

(56) References Cited

U.S. PATENT DOCUMENTS

| | | | | |
|---|---|---|---|---|
| 6,182,572 | B1 * | 2/2001 | McKillip | B41F 17/02 101/494 |
| 6,803,084 | B1 * | 10/2004 | Do | B65C 9/0006 283/103 |
| 2012/0239079 | A1 * | 9/2012 | Cohen | A45D 44/22 606/204.25 |

FOREIGN PATENT DOCUMENTS

| | | |
|---|---|---|
| JP | 3520693 B2 | 4/2004 |
| JP | 3572840 B2 | 10/2004 |

* cited by examiner

*Primary Examiner* — Alejandro Valencia

(74) *Attorney, Agent, or Firm* — Drinker Biddle & Reath LLP

(57) ABSTRACT

A label medium and an apparatus for manufacturing the label medium are provided. The label medium includes a release sheet and an adhesive sheet temporarily adhered to the release sheet. The adhesive sheet has a base layer and an adhesive layer provided on the base layer. The adhesive sheet includes a plurality of label parts printed on the base layer and a frame part provided outside the label parts. The adhesive sheet is cut along an outline of each of the label parts. The frame part includes a peeling direction indicating portion to indicate a peeling direction in which the frame part is peeled off from the release sheet, the peeling direction being substantially perpendicular to one side of the outline of the label part.

8 Claims, 25 Drawing Sheets

LABEL MEDIUM AND LABEL MANUFACTURING APPARATUS

CROSS-REFERENCE TO RELATED APPLICATION(S)

The present application claims priority to Japanese Patent Application No. 2013-195374 filed on Sep. 20, 2013, the entire content of which is incorporated herein by reference.

TECHNICAL FIELD

The present invention relates to a label medium having a release sheet and an adhesive sheet temporarily adhered to the release sheet, the adhesive sheet having a base layer and an adhesive layer provided on the base layer, and a label manufacturing apparatus configured to print labels on the label medium.

BACKGROUND

A related art label medium is in a form of a strip, and has a release sheet and an adhesive sheet temporarily adhered to the release sheet. A plurality of label parts is printed on the label medium. In the example shown in FIG. 33, a label medium 201 has rectangular label parts 202 arranged such that three label parts are aligned in a vertical direction and four label parts are aligned in a horizontal direction, and the label medium is half-cut along an outline 203 of each label part 202. Each label part 202 is configured such that the label part 202 can be peeled off from the release sheet by cutting a base layer on which the label part 202 is printed and an adhesive layer provided on the base layer with a plotter cutter or the like and not cutting the release sheet. When using the label medium, a frame part 204 provided outside the label parts 202 is first peeled off from the release sheet, so that only the label parts 202 remain on the release sheet. Accordingly, a user can easily peel off the label parts 202, easily check the remaining number of the label parts 202, and easily manage the number of workers. After that, each label part 202 is sequentially peeled off from the release sheet by the user and is then adhered to a target.

When peeling off the frame part 204 forming a part of the adhesive sheet from the release sheet, in most cases, the user starts to obliquely peel off the frame part 204 from a corner part of the label medium 201, as shown by an arrow 205. When peeling off the frame part 204 from the release sheet, the label part 202 may be peeled off together with the frame part 204 due to the label part 202 being coupled to the frame part 204.

The reason is as follows. Even after the half-cutting, that is, cutting the base layer and the adhesive layer while remaining the release sheet uncut, the cut adhesive layers are again closely contacted to each other. Also, the adhesive layer is sometimes not completely cut. Further, a corner portion 202*c* of the label part 202 has a small adhesion area between the adhesive sheet and the release sheet. Therefore, a holding force of the adhesive layer of the corner portion to the release sheet is small, so that the label part 202 forming a part of the adhesive sheet and the release sheet are likely to separate from each other. In addition to this, even though the adhesive sheet and the release layer are likely to separate from each other, a peeling force is applied to the corner portion 202*c* from sides 202*a*, 202*b* interposing the corner portion 202*c* therebetween and the force is thus concentrated thereto.

For this reason, as shown with the arrow 205, when the user starts to peel off the frame part 204 from the release sheet from an oblique direction with respect to a longitudinal direction of the label part 202, if the adhesive layer of the label part 202 and the adhesive layer of the frame part 204 are not sufficiently separated, the label part 202 is coupled to the frame part 204 by the adhesive force of the corresponding part, so that it is peeled off together with the frame part 204.

In such a case, the user has to separate the label part 202 and the frame part 204 while peeling off the frame part 204 from the release sheet, which deteriorates the operation efficiency. Also, the adhesive layer of the label part 202 and the adhesive layer of the frame part 204 may adhere to each other, so that the label medium 201 cannot be used and may be wasted. Further, peeling off the frame part 204 without peeling off the label part 202 together requires skill. Also, separating the coupled label part 202 from the frame part 204 that has already started to be peeled off requires skill.

To address the problem described above, a related art apparatus uses a thermosensitive adhesive tape during the process of thermal transfer printing to peel off the frame part from the release sheet (see, e.g., JP3572840B2). According to another related art apparatus, the frame part is divided into a plurality of sections during the cutting process so that the frame part is easily removed from the release sheet (see, e.g., JP3520693B2).

SUMMARY

An object of the present invention is to provide a label medium from which a frame part can be peeled off efficiently while preventing a label part from being peeled off together with the frame part, and a label manufacturing apparatus configured to manufacture the label medium.

According to an aspect of the present invention, a label medium includes a release sheet and an adhesive sheet temporarily adhered to the release sheet. The adhesive sheet has a base layer and an adhesive layer provided on the base layer. The adhesive sheet includes a plurality of label parts printed on the base layer and a frame part provided outside the label parts. The adhesive sheet is cut along an outline of each of the label parts. The frame part includes a peeling direction indicating portion to indicate a peeling direction in which the frame part is peeled off from the release sheet, the peeling direction being substantially perpendicular to one side of the outline of the label part. Here, the peeling direction indicating portion may be provided in a form of a printed arrow or a tab. Also, at least a portion of the label parts may be printed while cutting the adhesive sheet along the outline of each label part.

The plurality of label parts may include a first group of label parts provided in a give arrangement and one or more subsequent groups of label parts as copies of the first group. The first group and the one or more subsequent groups may be provided in series along a longitudinal direction of the label medium. The peeling direction indicating portion may be provided in front of the first group. In this case, the label medium may not be cut or may be cut in the width direction of the label medium at the border part between the groups. When the label medium is cut in the width direction, the peeling direction indicating portion may be provided in front of each of the groups.

According to another aspect of the present invention, a label manufacturing apparatus is provided to form an image on a label medium. The label medium includes a release sheet and an adhesive sheet temporarily adhered to the release sheet. The adhesive sheet has a base layer and an adhesive layer provided on the base layer. The label manufacturing apparatus includes a feeding mechanism configured to convey the label medium, a printing head configured to print an image on the base layer to form a plurality of label parts, a cutting mechanism configured to cut the adhesive sheet along an outline of each of the label parts, and a controller configured to control the feeding mechanism and the cutting mechanism to form a peeling direction indicating portion on a frame part provided outside the label parts of the label medium, the peeling direction indicating portion indicating a peeling direction in which the frame part is peeled off from the release sheet. The controller may be configured to print the label parts by the printing head while cutting the adhesive sheet by the cutting mechanism.

The plurality of label parts may include a first group of label parts provided in a give arrangement and one or more subsequent groups of label parts as copies of the first group. The controller may be configured to sequentially print the first group and the one or more subsequent groups along a longitudinal direction of the label medium, and to provide the peeling direction indicating portion in front of the first group. The label manufacturing apparatus may further include an additional cutting mechanism configured to cut the label medium in a width direction of the label medium at a border part between the groups. The controller may be configured to cut the label medium in the width direction at the border part by the additional cutting mechanism.

According to the label medium described above, the peeling direction indicating portion is provided on the frame part to indicate a peeling direction in which the frame part is peeled off from the release sheet, the peeling direction being substantially perpendicular to one side of the outline of the label part. Therefore, when the frame part is peeled off in accordance with the peeling direction indicating portion, a peeling force is applied to the one side of the label part, not to a corner portion of the label part. Thus, even if the adhesive layer of the label part and the adhesive layer of the frame part are adhered to each other, the frame part and the label part are reliably separated, only the frame part is peeled off from the release sheet, and the label parts remain on the release sheet. As a result, it is possible to prevent the label part from being peeled off together with to the frame part.

According to the label manufacturing apparatus described above, it is possible to manufacture a label medium in which the peeling direction indicating portion is provided on the frame part to indicate a peeling direction in which the frame part is peeled off from the release sheet, the peeling direction being substantially perpendicular to one side of the outline of the label part. When the label manufacturing apparatus is configured such that the half-cutting of the label medium along the outline of the frame part is performed together with the printing of the label parts, it is possible to shorten the overall time after the printing starts until the label medium is discharged. In other words, the productivity of the label medium is improved by enabling at least a portion of the half-cutting and the printing to temporally overlap. The half-cutting by the cutting mechanism may be continuously performed before the start of the printing until the printing is over, so as to remove the variation in the load applied to the moving label medium and the variation in the feeding speed of the label medium during the printing and to thus prevent an image quality from being deteriorated due to the printing non-uniformity of the label parts.

DETAILED DESCRIPTION

Hereinafter, embodiments of the present invention will be described in detail with reference to the drawings.

1. Printer

Figure 1:
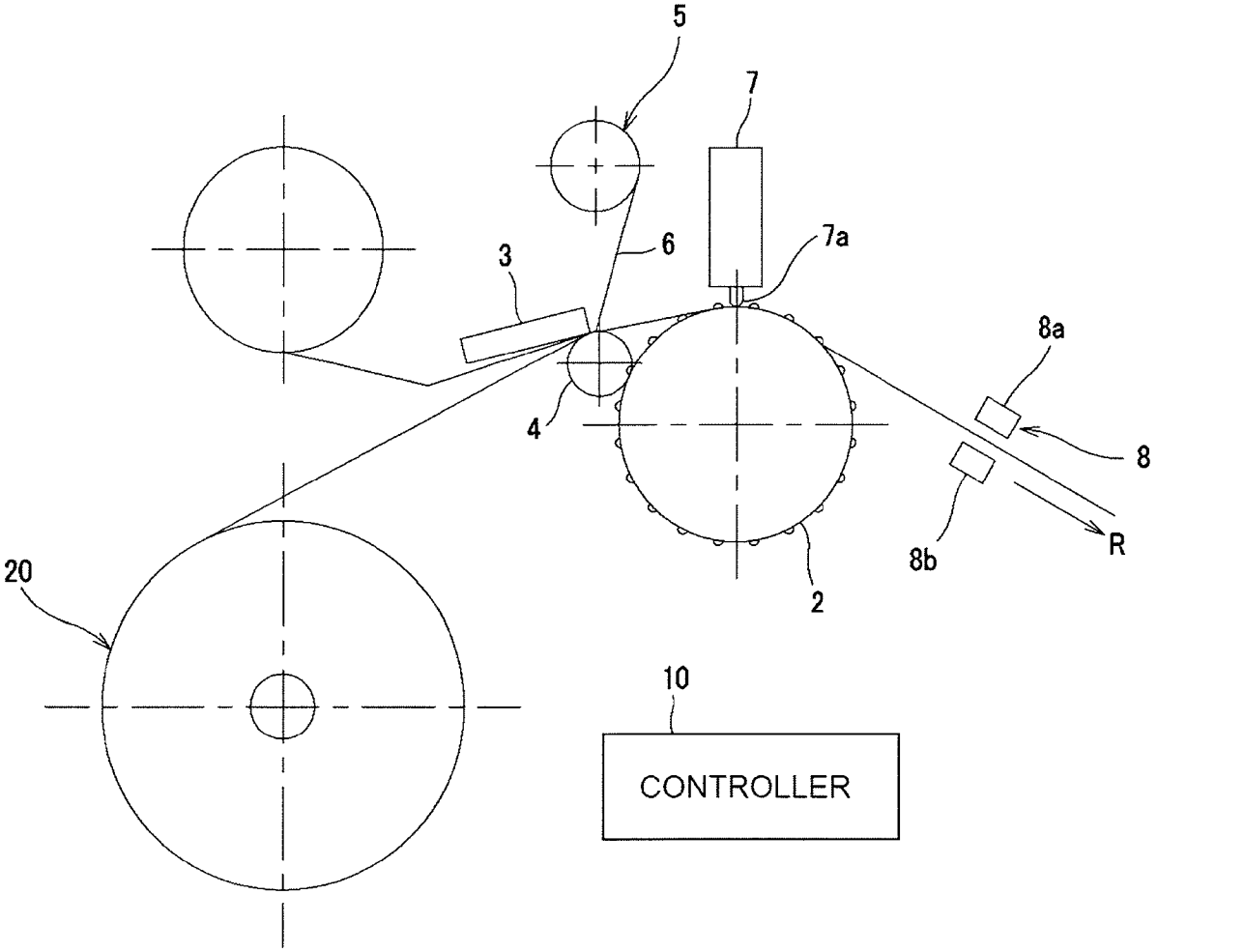
FIG. 1 is a diagram illustrating a configuration of a printer.

FIG. 1 illustrates a printer 1, an example of a label manufacturing apparatus according to an embodiment of the present invention. A roll of label medium 20 is mounted on the printer 1. The roll of label medium 20 is rotatably accommodated in a medium accommodating portion of the printer 1. The blank label medium 20 taken out from the medium accommodating portion and is fed by a sprocket 2 (an example of a feeding mechanism) engaging with sprocket holes 2*a* of the label medium 20 and is guided by guide pins (not shown) and guide rollers (not shown). In the printer 1, a thermal head 3 configured to apply the thermal energy in accordance with print data is arranged to face a platen 4 at an upstream side of the sprocket 2 in a feeding direction R. Further, the printer 1 is mounted with an ink ribbon cartridge 5, and an ink ribbon 6 is interposed between the thermal head 3 and the platen 4. The ink ribbon 6 is superimposed between the thermal head 3 and the platen 4 and is pressed to a base layer configuring a printing surface of the label medium 20. The label medium 20 is applied with the thermal energy by the thermal head 3 in accordance with the print data, so that the dye of the ink ribbon 6 is transferred to the base layer of the label medium 20 and an image is thus formed.

Further, a first cutting mechanism 7 configured to cut the label medium 20 having label parts printed thereon is provided in the vicinity of the sprocket 2. A cutting tool 7*a* having a tip becoming a cutting edge is mounted to a cutting head configured to move in a width direction of the label medium 20, i.e., a direction orthogonal to the feeding direction of the label medium 20, so that the first cutting mechanism 7 is configured. A pressure of the cutting edge of the cutting tool 7*a* is adjusted to cut a base layer and an adhesive layer of the label medium 20 and not to cut a release sheet, i.e., to half-cut the label medium 20.

Further, a second cutting mechanism 8 configured to cut the label medium 20 in the width direction over an entire width is provided at a downstream side of the first cutting mechanism 7. The second cutting mechanism 8 has a structure where metal plates 8*a*, 8*b* are superposed about a support point serving as a central axis, like scissors, and is configured to completely cut the label medium 20 in a thickness direction over the entire width of the label medium 20, i.e., to fully cut the label medium 20. The second cutting mechanism 8 may have the same configuration as the first cutting mechanism 7, and a pressure of a cutting edge thereof may be adjusted to cut not only the base layer and the adhesive layer but also the release sheet.

Figure 2:
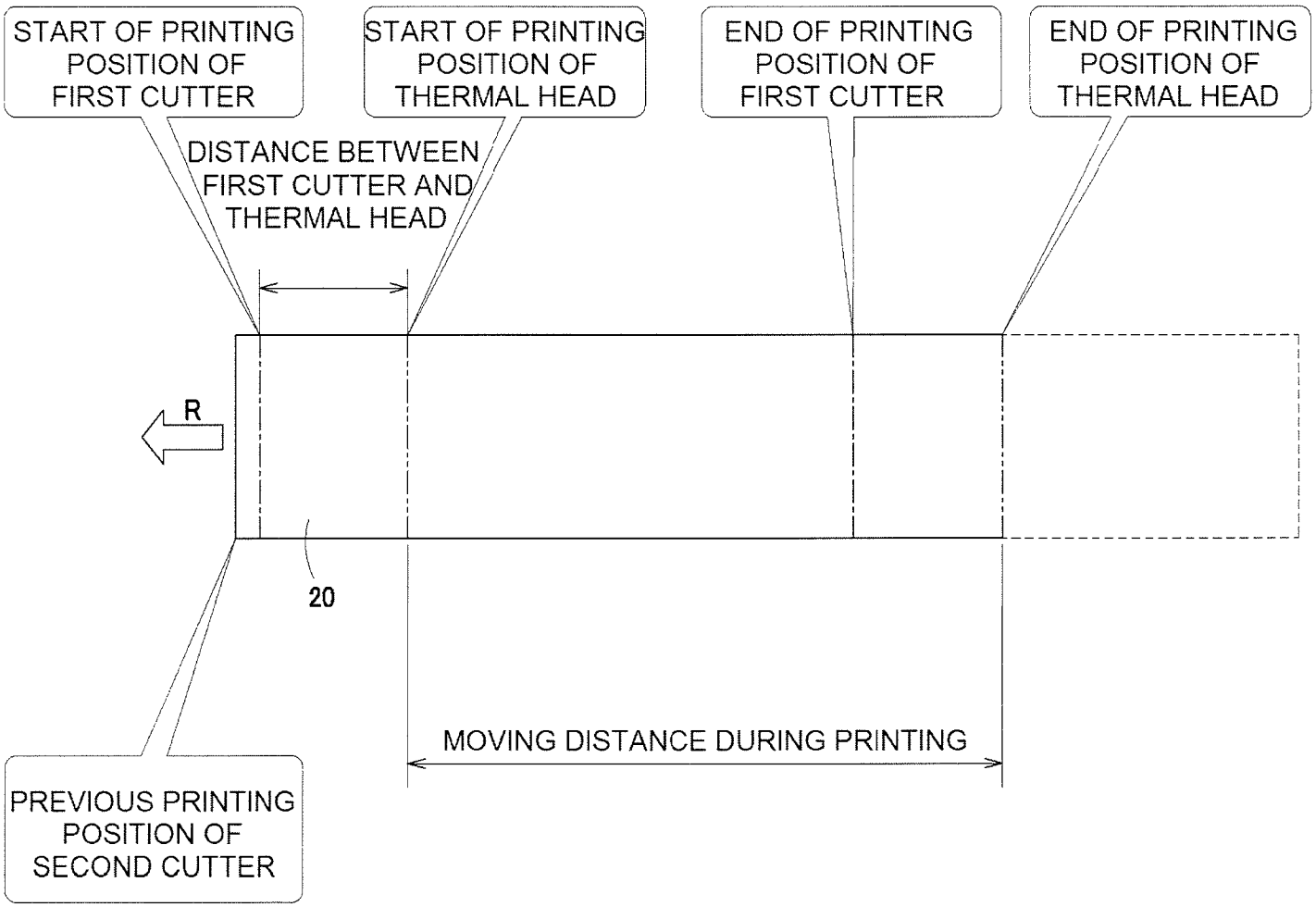
FIG. 2 is a diagram illustrating a positional relation among a label medium, a thermal head and a second cutting mechanism.

A relation among the thermal head 3, the first cutting mechanism 7 and the label medium 20 is described. As shown in FIG. 1, the printer 1 is provided with the second cutting mechanism 8, the first cutting mechanism 7 and the thermal head 3 in order from the downstream side of the feeding direction of the label medium 20. As shown in FIG. 2, the label medium 20 is provided with an unprintable blank region corresponding to a distance between the first cutting mechanism 7 and the thermal head 3. The label medium 20 is cut over the entire width by the second cutting mechanism 8, and the corresponding cutting position becomes a leading position in next processing of the label medium 20.

The printer 1 configured as described above is configured to control a driving motor, which is a driving source of the feeding mechanism, a driving motor or solenoid, which is a driving source for moving the cutting tool 7*a* of the first cutting mechanism 7 or pressing the same to the label medium 20, and a driving motor, which is a driving source for driving the scissors of the second cutting mechanism 8, by a controller 10. The controller 10 is a microcomputer, for example, and is configured to control an overall operation in response to a control program stored in a ROM. For example, the controller 10 is configured to drive the feeding mechanism and the thermal head, to generate cutting data for specifying a half-cut or full cut position and to control the first cutting mechanism 7 and the second cutting mechanism 8, in accordance with the print data of the label part input from an information processing apparatus such as an external PC and a workstation. Also, when starting a printing, the controller 10 performs the printing while half-cutting the label medium 20 with the cutting tool 7*a* of the first cutting mechanism 7.

2. Label Medium

Figure 3:
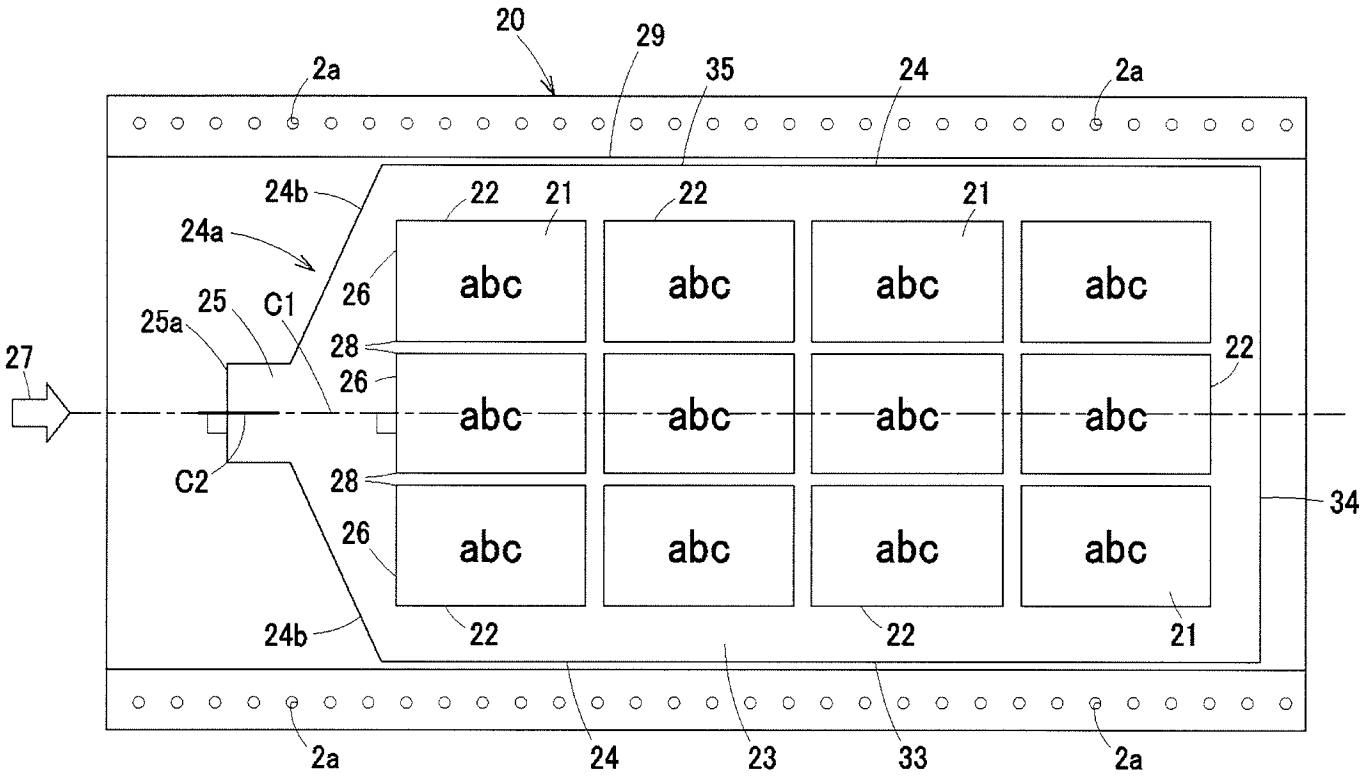
FIG. 3 is a plan view of a label medium.
Figure 4:
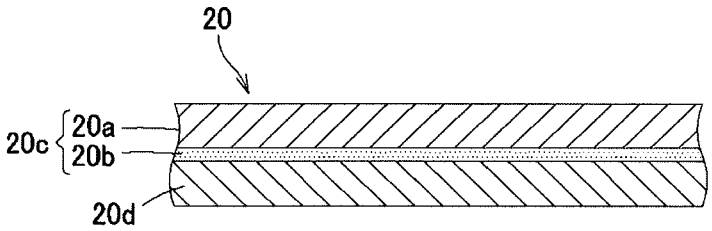
FIG. 4 is a sectional view of the label medium.

As shown in FIGS. 3 and 4, in the label medium 20 used for the printer 1 to which the present invention is applied, an adhesive layer 20*b* is formed on an opposite surface to a printing surface of a base layer 20*a* on which the printing is performed, so that an adhesive sheet 20*c* is configured. A release sheet 20*d* is adhered to the adhesive layer 20*b*. As shown in FIG. 3, the label medium 20 has an overall rectangular shape. Here, label parts 21 are arranged so that three label parts are aligned in a vertical direction and four label parts are aligned in a horizontal direction. The twelve label parts configure one group. Meanwhile, the number of the label parts 21 and the arrangement method thereof in one group are not limited to the example of FIG. 3. Also, the shape of the label part 21 is not particularly limited. For example, as described later, the label part 21 may have a polygonal shape such as a triangle, a pentagon, a hexagon and the like, a circular shape, a combination shape of a polygon and a circle, and the like. Here, a general rectangular shape is exemplified.

In the label medium 20, an outline 22 of each label part 21 is half-cut. That is, the outline 22 is configured such that the base layer 20*a* and the adhesive layer 20*b* are cut by the cutting tool 7*a* of the first cutting mechanism 7 of the printer 1 and only the release sheet 20*d* is not cut. A part of the label medium 20 other than the label parts 21 is a frame part 23 provided outside the label parts 21. An outline 24 of the frame part 23 is formed at a slight inner side of an outer edge part of the label medium 20 in the longitudinal direction of the label medium 20. Also, a leading part 24*a* of the outline 24 is provided with inclined sides 24*b*, 24*b* inclined from both sides of the outline 24 towards a central part, and the central part is formed with a tab part 25 becoming a peeling direction indicating portion configured to indicate a peeling direction in which the frame part 23 is peeled off from the release sheet 20*d*. The outline 24 of the frame part 23 is also half-cut.

The tab part 25 provided at the leading part 24*a* of the label medium 20 is formed so that a central line C2 passing through a center thereof in a width direction coincides with a central line C1 passing through a center of the label medium 20 in the width direction. Also, the tab part 25 is formed to be substantially perpendicular to a leading side 26 of each aligned label part 21 in the width direction. That is, the tab part 25 further protruding between the inclined surfaces 24*b*, 24*b* inclined towards a tip edge of the label medium 20 is formed, so that the tab part 25 can urge a user to intuitively start peeling off the frame part 23 from the tab part 25. That is, the tab part 25 serves as an index, so that the user first peels off the tab part 25 from the release sheet 20*d*, pulls the frame part 23 in a direction shown with an arrow 27 in FIG. 3 and thus peels off the frame part 23 from the release sheet 20*d*.

In this way, the peeling force is not concentrated on corner portions 28, 28 of the leading side of each label part 21 and is applied to one side 26 of the label medium 20 in the width direction. The one side 26 has a larger contact area with the release sheet 20*d* than the corner portions 28, 28. Therefore, in the label medium 20, even if the adhesive layer 20*b* of the label part 21 and the adhesive layer 20*b* of the frame part 23 are adhered to each other, only the frame part 23 is peeled off from the release sheet 20*d* and the label parts 21 remain on the release sheet 20*d*. As a result, it is possible to prevent the label part 21 from being peeled off with being coupled to the frame part 23, which occurs in the related art. A relation between the tab part 25 and the one side 26 is not necessarily strictly perpendicular and may slightly deviate from the perpendicular state.

Half-cutting lines 29 configured to separate an inner printing region and a line of the sprocket holes 2*a* are formed in parallel with each other at an inner side of the sprocket holes 2*a*. The half-cutting line 29 is provided for the label medium 20 from the beginning and is not formed by the first cutting mechanism 7 or second cutting mechanism 8 of the printer 1. There is also a label medium 20 in which the halt cutting lines 29 are not provided and the adhesive sheet 20*c* is formed on the entire release sheet 20*d*. Also, the region in which the sprocket holes 2*a* are arranged is a region in which the half-cutting cannot be performed for the adhesive sheet 20*c* by the cutting tool 7*a*, and sides 33, 35 are necessarily formed when forming the frame part 23.

3. First Modified Example of Label Medium

Figure 5:
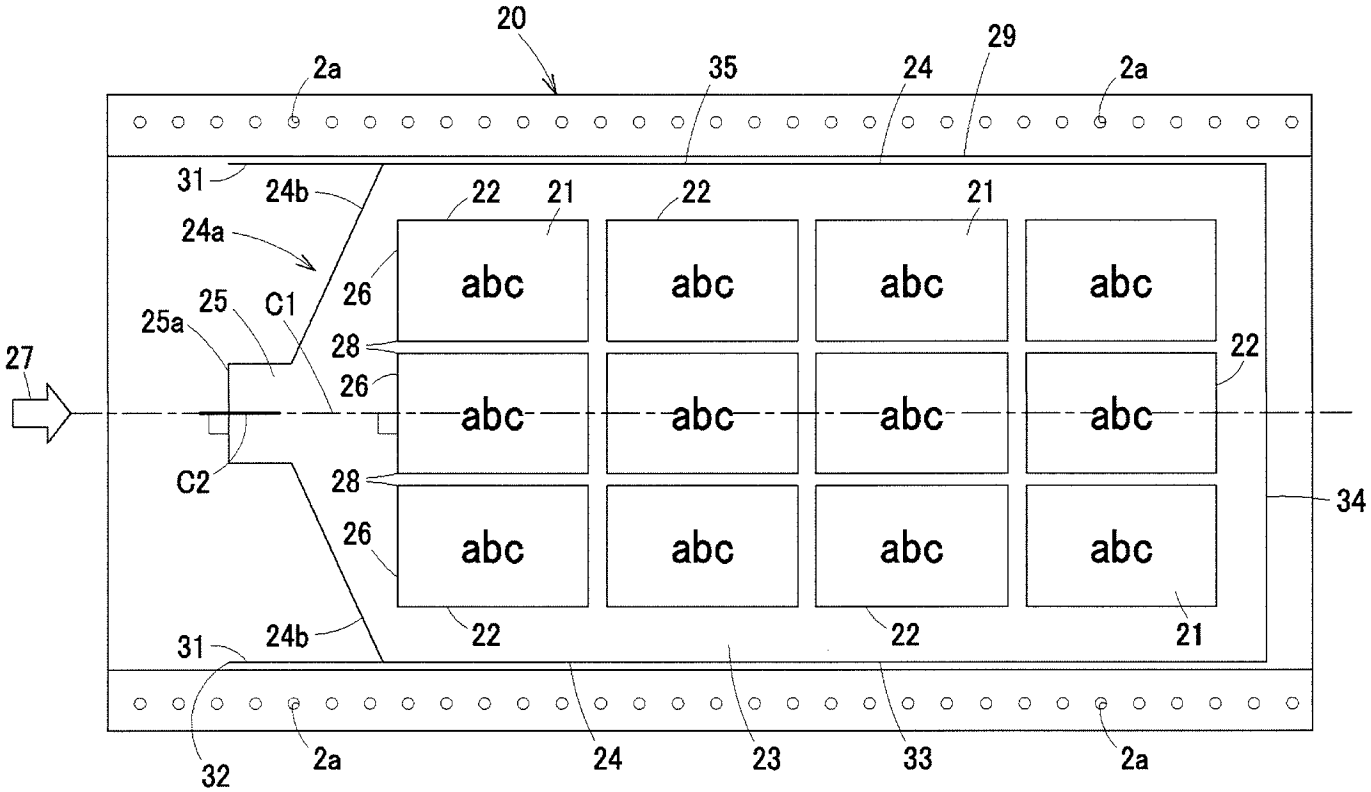
FIG. 5 is a plan view of a first modified example of the label medium.

The outline 24 of the frame part 23 of the label medium 20 may be formed as shown in FIG. 5. That is, in a first modified example of FIG. 5, extension lines 31 are formed at both ends of the outline 24 facing the tip-side of the label medium 20.

A sequence of cutting the label parts 21 of the label medium 20 shown in FIG. 5 by the printer 1 is described with reference to FIGS. 6 and 7. First, the controller 10 lowers the cutting tool 7*a* of the first cutting mechanism 7 and presses the same to a starting position of the label medium 20 with a predetermined pressure. Here, as shown in FIG. 7, the starting position is a tip portion 32 of the one extension line 31. Then, the controller 10 drives the driving motor of the feeding mechanism in a forward direction and rotates the sprocket 2 in the forward direction, thereby moving the label medium 20 in the arrow R direction of FIG. 1. Thereby, the one extension line 31 is half-cut (see (1) in FIGS. 6 and 7).

Figure 6:
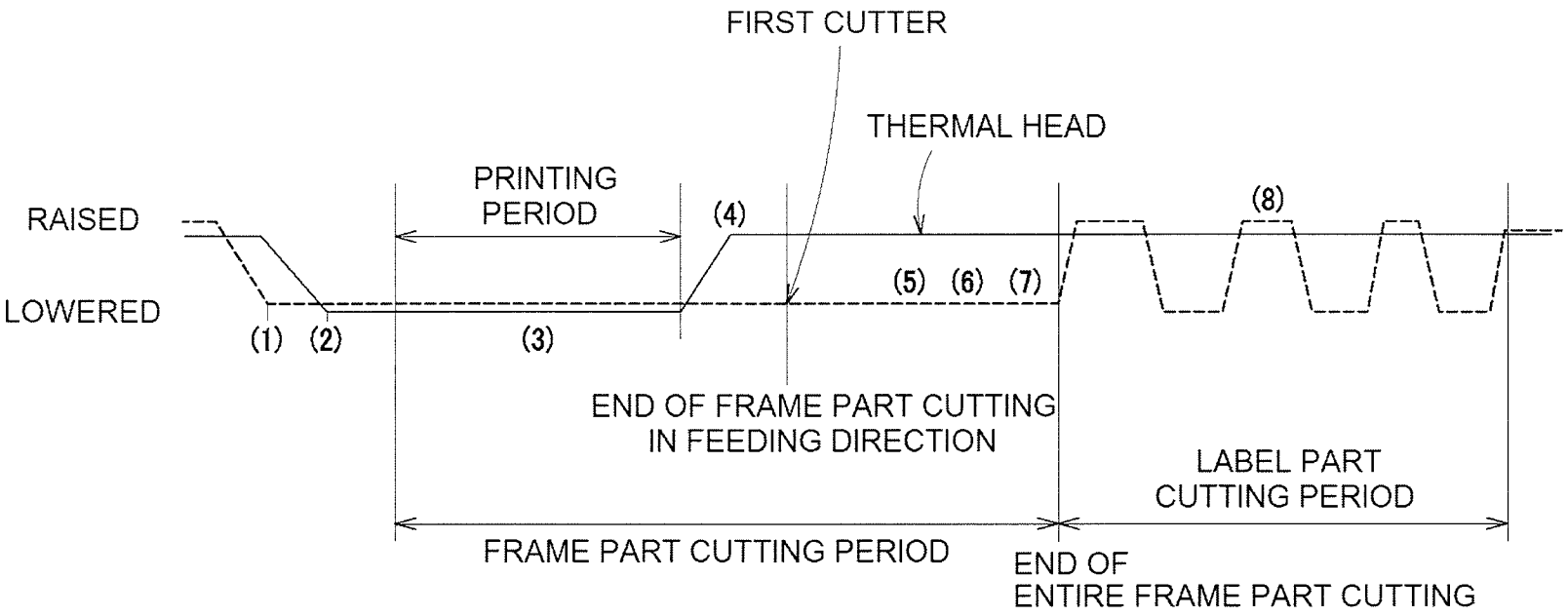
FIG. 6 is a timing chart illustrating operations of the thermal head and the second cutting mechanism.
Figure 7:
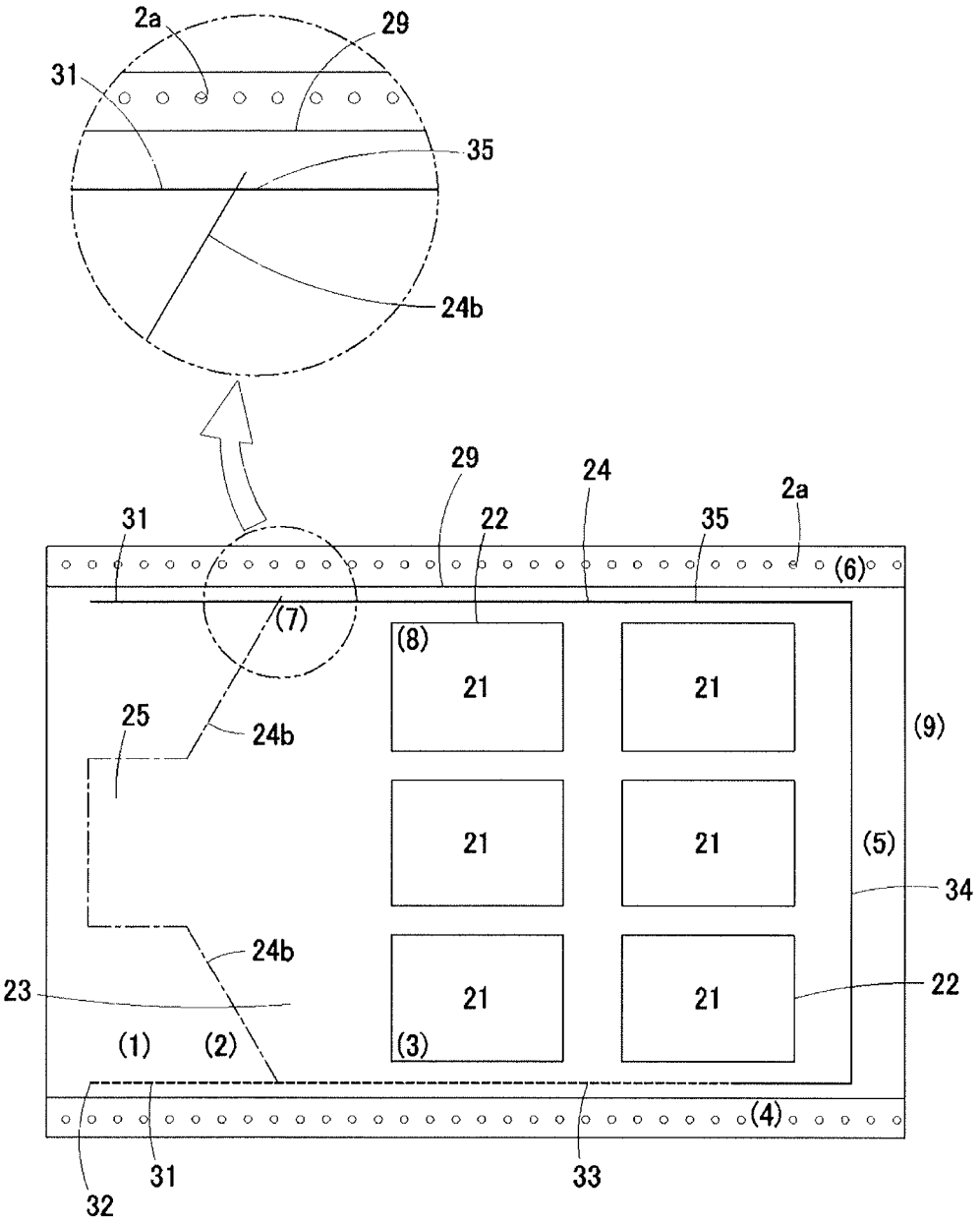
FIG. 7 is a diagram illustrating a sequence of cutting operations for the label medium according to the first modified example of FIG. 5.

At the same time or before or after the above processing, the controller 10 lowers the thermal head 3 to press the label medium 20 to the platen 4 (see (2) in FIGS. 6 and 7). At this time, the controller 10 does not supply the print data to the thermal head 3 and does not print anything on the label medium 20. Then, when the label medium 20 is conveyed to a print starting position of the print data and the conveying speed of the label medium 20 becomes a constant speed conveyance state, the controller 10 supplies the thermal energy corresponding to the print data to the thermal head 3, thereby printing a letter and the like on the label medium 20 (see (3) in FIGS. 6 and 7). In this period, the cutting tool 7*a* continues to half-cut the one side 33 of the outline 24 of the frame part 23. Thereby, upon the print starting, the label medium 20 is already applied with a load for the half-cutting by the cutting tool 7*a* and a load of the thermal head 3. Also, even when the printing is performed at the constant speed conveyance state of the label medium 20, the corresponding state is not changed and the load is not varied. Therefore, it is possible to prevent a printing non-uniformity from being generated due to the variation in the feeding speed of the label medium 20 during the printing.

When the printing period is over, the controller 10 raises the thermal head 3 and separates the same from the label medium 20. In this state, the half-cutting by the cutting tool 7*a* continues (see (4) in FIGS. 6 and 7). Then, the controller 10 drives the driving motor of the first cutting mechanism 7 to move the cutting tool 7*a* in the width direction of the label medium 20, thereby half-cutting a side 34 of the frame part 23 in the width direction (see (5) in FIGS. 6 and 7). After that, the controller 10 drives the driving motor of the feeding mechanism in a reverse direction, thereby reversely conveying the label medium 20 in an opposite direction to the arrow R in FIG. 1. Thereby, the cutting tool 7*a* half-cuts the side 35 of the frame part 23 and the extension line 31 continuing from the side 35 (see (6) in FIGS. 6 and 7). The extension line 31 continuing from the side 35 may not be formed.

Thereafter, the controller 10 half-cuts the leading part 24*a* including the tab part 25 of the label medium 20 by the cutting tool 7*a*. Specifically, the controller 10 controls the driving motor of the feeding mechanism and the driving motor of the first cutting mechanism 7 to reversely or forwardly feed the label medium 20, to lower and raise the cutting tool 7*a* and to move the cutting tool 7*a* in the width direction, thereby half-cutting the outlines of the inclined sides 24*b*, 24*b* and the tab part 25 (see (7) in FIGS. 6 and 7). At this time, the controller 10 performs the half-cutting so that the side 35 and the inclined side 24*b* intersect with each other, i.e., sets a cut starting end of the cutting tool 7*a* at an outer side of the side 35 and then performs the half-cutting towards an inner side of the side 35. Thereby, it is possible to prevent the cutting from remaining without being performed. Also, the controller 10 performs the half-cutting so that the side 33 and the inclined side 24*b* intersect with each other, i.e., sets a cut ending end of the cutting tool 7*a* at an outer side of the side 33 and then performs the half-cutting towards an outer side of the side 33. Thereby, it is possible to prevent the cutting from remaining without being performed.

When the half-cutting for the outline 24 of the frame part 23 and the leading part 24*a* is completed, the controller 10 moves the label medium 20 for which the printing has been completed in the forward direction, and raises and lowers the cutting tool 7*a* to perform the half-cutting for the outline 22 of each label part 21 in conformity to the number and shapes of the label parts 21 (see (8) in FIGS. 6 and 7).

When the half-cutting for the outline 22 of each label part 21 is completed, the controller 10 cuts (fully cuts) the label medium 20 over the entire width by the second cutting mechanism 8 (see (9) in FIG. 7). The cutting (full cutting) of the label medium 20 by the second cutting mechanism 8 is not necessarily automatically performed and may be performed optionally by the user.

On the other hand, the half-cutting for the extension lines 31, 31 may be omitted for the label medium 20 having no extension line 31 shown in FIG. 3.

According to the processing of the printer 1 as described above, when half-cutting the outline 24 of the frame part 23, the printing of the label parts 21 is also performed. Therefore, it is possible to shorten the overall time after the printing starts until the label medium 20 is discharged. Also, according to the related art, the half-cutting of the outline 24 is performed after the printing of the label parts 21 is over. Thus, the printing is performed so that an extra load other than the load applied to the label medium 20 from the thermal head 3 is not applied as much as possible. However, according to the printer 1, the half-cutting by the cutting tool 7*a* is continuously performed before the start of the printing until the printing is over. Therefore, it is possible to remove the variation in the load and the variation in the feeding speed of the label medium 20 during the printing and to thus prevent an image quality from being deteriorated due to the printing non-uniformity of the label parts 21.

4. Second and Third Modified Examples of Label Medium

Figure 8:
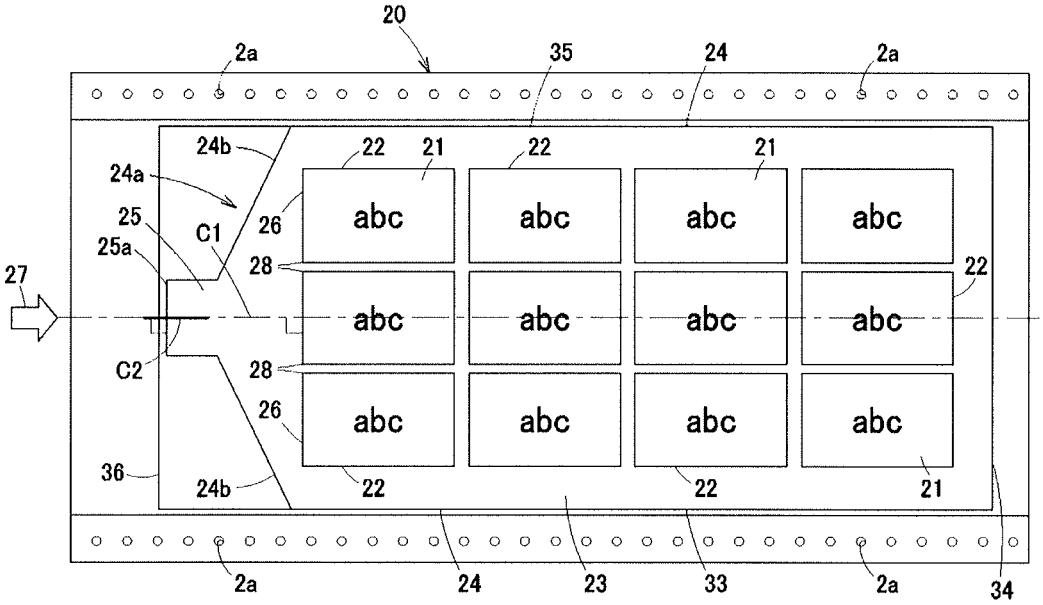
FIG. 8 is a plan view of a second modified example of the label medium.
Figure 9:
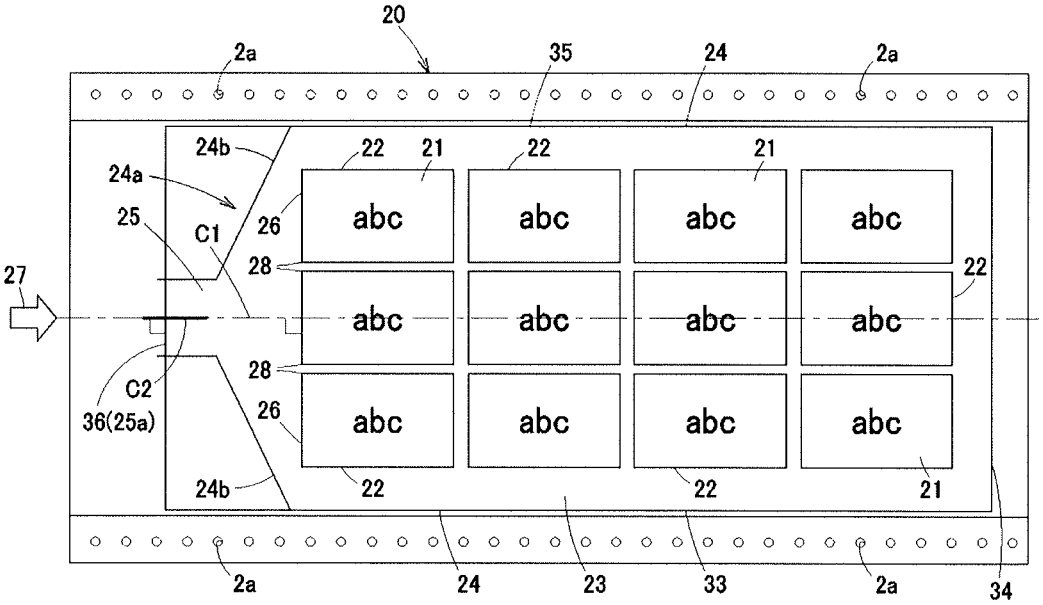
FIG. 9 is a plan view of a third modified example of the label medium.
Figure 10:
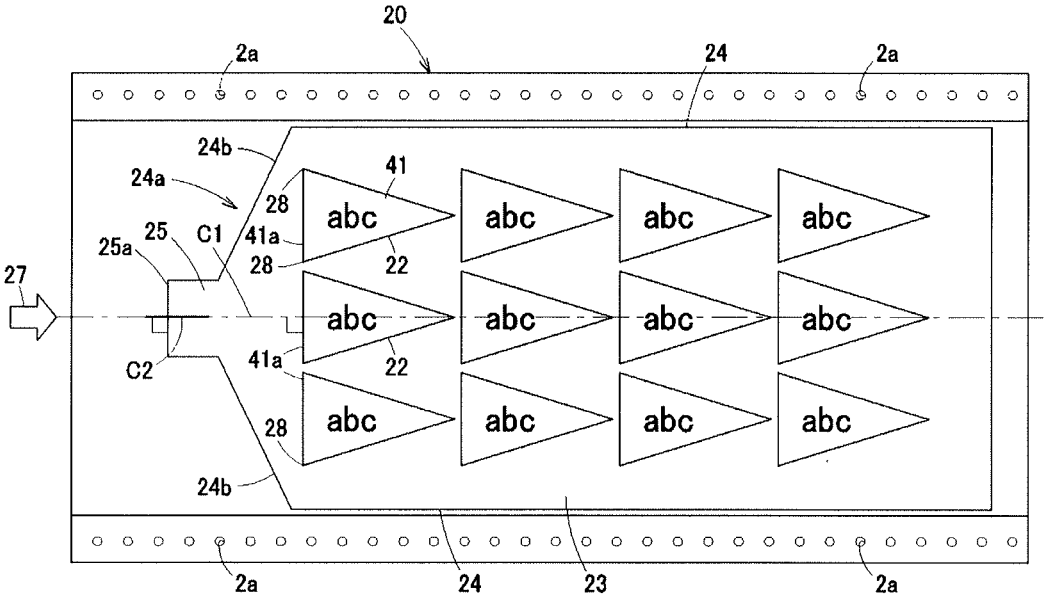
FIG. 10 is a plan view of a fourth modified example with triangular label parts.

A second modified example of the label medium 20 is described. For the label medium 20 shown in FIG. 8, the half-cutting may be performed for an additional side 36 connecting the tip portions of the extension lines 31, 31 continuing from the sides 33, 35 of the frame part 23. Also, in a third modified example of the label medium 20, the side 36 is matched with a side 25*a* of the tab part 25 in the width direction, as shown in FIG. 9.

5. Fourth to Seventh Modified Examples of Label Medium (Triangular Examples)

In the above embodiments, each label part 21 has the rectangular shape. However, the label part 21 may have a triangular shape, as shown in FIGS. 10 to 13. In a fourth modified example shown in FIG. 10, a triangular label part 41 is arranged so that a base 41*a* thereof is parallel with the width direction of the rectangular label medium 20, is positioned at the leading-side (the left side in FIG. 10) of the label medium 20 and is substantially perpendicular to the longitudinal direction of the label medium 20. In this case, like the examples of FIGS. 3, 5, 8 and 9, the tab part 25 is formed so that the central line C2 in the width direction coincides with the central line C1 passing through the center of the label medium 20 in the width direction. Thereby, the tab part 25 serves as an index, so that the user first peels off the tab part 25 from the release sheet 20*d*, pulls the frame part 23 in the direction shown with the arrow 27 in FIG. 10 and thus peels off the frame part 23 from the release sheet 20*d*. In this way, the peeling force is not concentrated on the two corner portions 28, 28 of the leading-side of each label part 41 and is applied to the base 41*a*. The base 41*a* has a larger contact area with the release sheet 20*d* than the corner portions 28, 28. Therefore, in the label medium 20, only the frame part 23 is peeled off from the release sheet 20*d* and the label parts 41 remain on the release sheet 20*d*. As a result, it is possible to prevent the label part 41 from being peeled off with being coupled to the frame part 23, which occurs in the related art.

Figure 11:
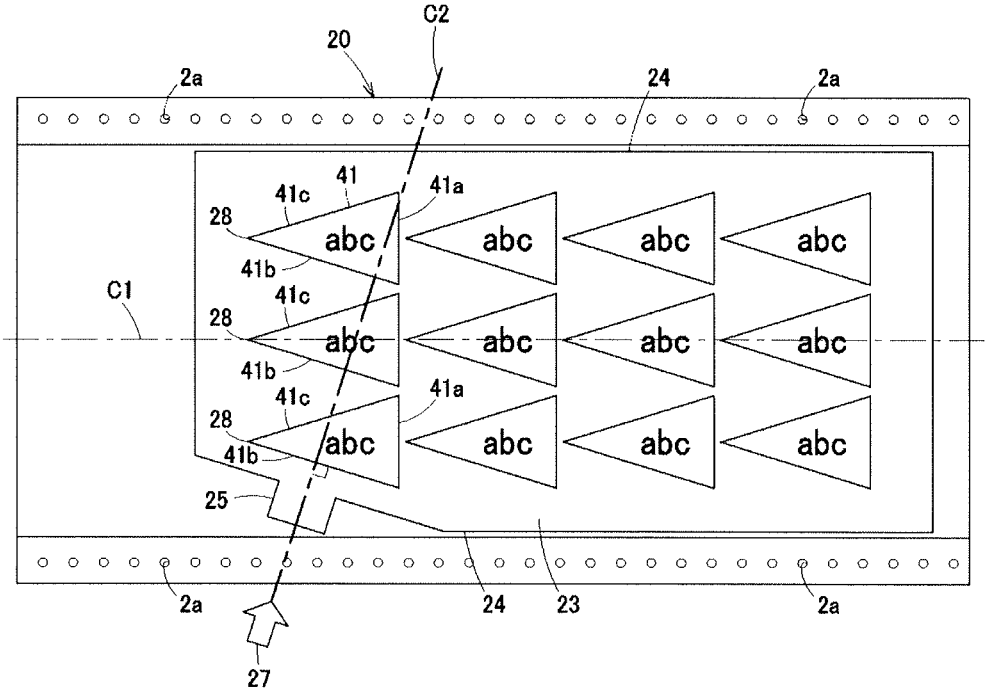
FIG. 11 is a plan view of a fifth modified example with triangular label parts.

In a fifth modified example shown in FIG. 11, the corner portion 28, which is an apex of the triangular label part 41, is positioned at the leading-side, and the base 41*a* is positioned at a rear side (the right side in FIG. 11) of the label medium 20 and is arranged to be substantially perpendicular to the longitudinal direction of the label medium 20. The tab part 25 is formed so that the central line C2 thereof is oblique relative to the central line C1 of the label medium 20 and is substantially perpendicular to one inclined side 41*b* of the label part 41. Thereby, the tab part 25 serves as an index, so that the user first peels off the tab part 25 from the release sheet 20*d*, pulls the frame part 23 in the direction shown with the arrow 27 in FIG. 11 and thus peels off the frame part 23 from the release sheet 20*d*. In this way, the peeling force is not concentrated on the corner portion 28 of the leading-side of each label part 41 and is applied to the inclined side 41*b*. Therefore, in the label medium 20, only the frame part 23 is peeled off from the release sheet 20*d* and the label parts 41 remain on the release sheet 20*d*. As a result, it is possible to prevent the label part 41 from being peeled off with being coupled to the frame part 23, which occurs in the related art. Meanwhile, in this modified example, even when the tab part 25 is provided at the other corner portion-side (the upper side in FIG. 11) of the side of the leading-side of the label medium 20, the same effect can be accomplished. In this case, the frame part 23 is pulled in a substantially perpendicular direction to the inclined side 41*c*.

Figure 12:
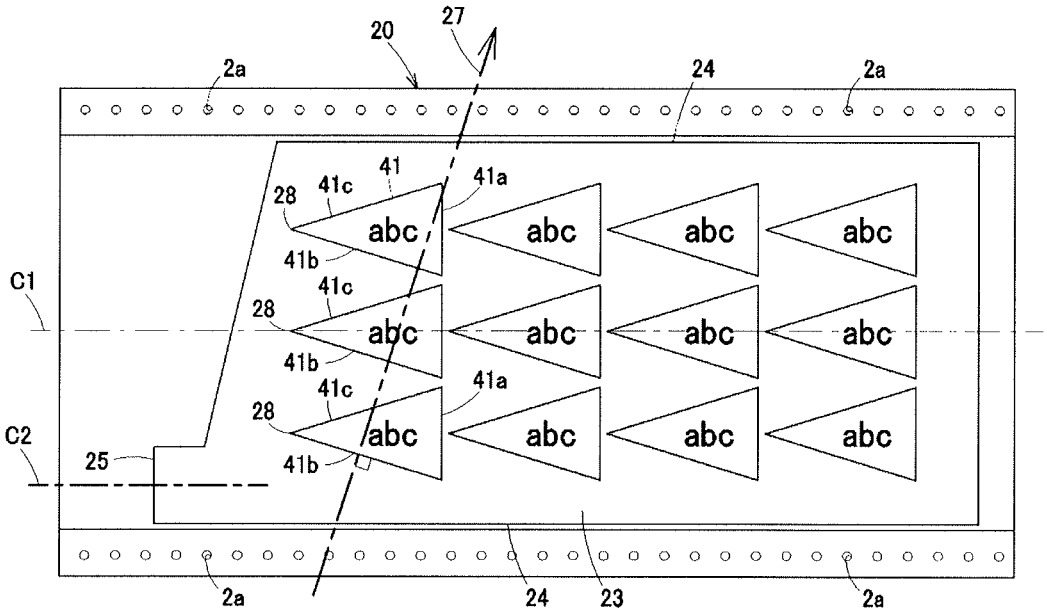
FIG. 12 is a plan view of a sixth modified example with triangular label parts.

In a sixth modified example shown in FIG. 12, like FIG. 11, the corner portion 28, which is an apex of the triangular label part 41, is positioned at the leading-side, and the base 41*a* is positioned at the rear side (the right side in FIG. 11) of the label medium 20 and is arranged to be substantially perpendicular to the longitudinal direction of the label medium 20. The tab part 25 is formed so that the central line C2 thereof is substantially parallel with the central line C1 of the label medium 20, and is provided at the one corner portion-side (the lower side in FIG. 12) of the side of the tip-side. Thereby, the tab part 25 serves as an index, so that the user first peels off the tab part 25 from the release sheet 20*d*, pulls the frame part 23 in the direction substantially perpendicular to the inclined side 41*b* and shown with the arrow 27 in FIG. 12 and thus peels off the frame part 23 from the release sheet 20*d*. In this way, the peeling force is applied to the inclined side 41*b*. Therefore, in the label medium 20, only the frame part 23 is peeled off from the release sheet 20*d* and the label parts 41 remain on the release sheet 20*d*. As a result, it is possible to prevent the label part 41 from being peeled off with being coupled to the frame part 23. Meanwhile, in this modified example, even when the tab part 25 is provided at the other corner portion-side (the upper side in FIG. 12) of the side of the tip-side of the label medium 20, the same effect can be accomplished. In this case, the frame part 23 is pulled in a substantially perpendicular direction to the inclined side 41*c* of the label part 41.

Figure 13:
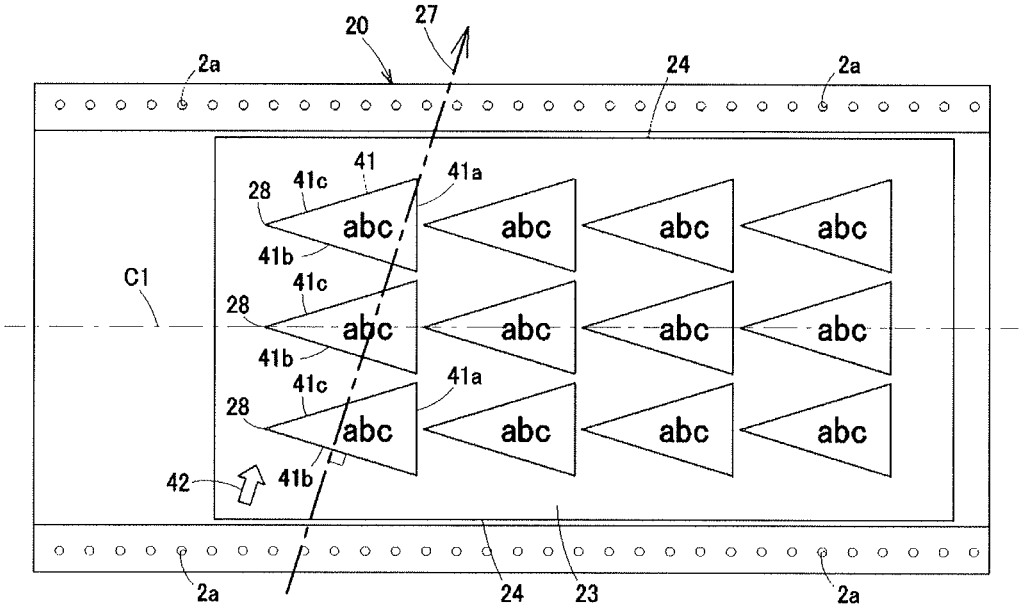
FIG. 13 is a plan view of a seventh modified example with triangular label parts.

In a seventh modified example shown in FIG. 13, like FIGS. 11 and 12, the corner portion 28, which is an apex of the triangular label part 41, is positioned at the leading-side, and the base 41*a* is positioned at the rear side (the right side in FIG. 11) of the label medium 20 and is arranged to be substantially perpendicular to the longitudinal direction of the label medium 20. In the seventh modified example, the tab part 25 serving as the peeling direction indicating portion is not provided. Instead, an arrow 42 printed substantially at the same time as the printing of the label parts 41 is provided. The arrow 42 is provided at the one corner portion-side (the lower side in FIG. 12) of the side of the tip-side of the label medium 20. Thereby, the arrow 42 serves as an index, so that the user first peels off a corner portion adjacent to the arrow 42 from the release sheet 20*d*, pulls the frame part 23 in the direction substantially perpendicular to the inclined side 41*b* and shown with the arrow 27 in FIG. 13 and thus peels off the frame part 23 from the release sheet 20*d*. In this way, the peeling force is applied to the inclined side 41*b* of the label part 21. Therefore, in the label medium 20, only the frame part 23 is peeled off from the release sheet 20*d* and the label parts 41 remain on the release sheet 20*d*. As a result, it is possible to prevent the label part 41 from being peeled off with being coupled to the frame part 23. Meanwhile, in this modified example, even when the arrow 42 is provided at the other corner portion-side (the upper side in FIG. 13) of the side of the tip-side of the label medium 20, the same effect can be accomplished. In this case, the frame part 23 is pulled in a substantially perpendicular direction to the inclined side 41*c* of the label part 41.

Meanwhile, here, the label part 41 having the isosceles triangular shape has been described. However, the triangular shape may be any shape such as an equilateral triangle, a scalene triangle, an acute triangle, an obtuse triangle and the like.

6. Eighth to Eleventh Modified Examples of Label Medium (Pentagonal Examples)

Figure 14:
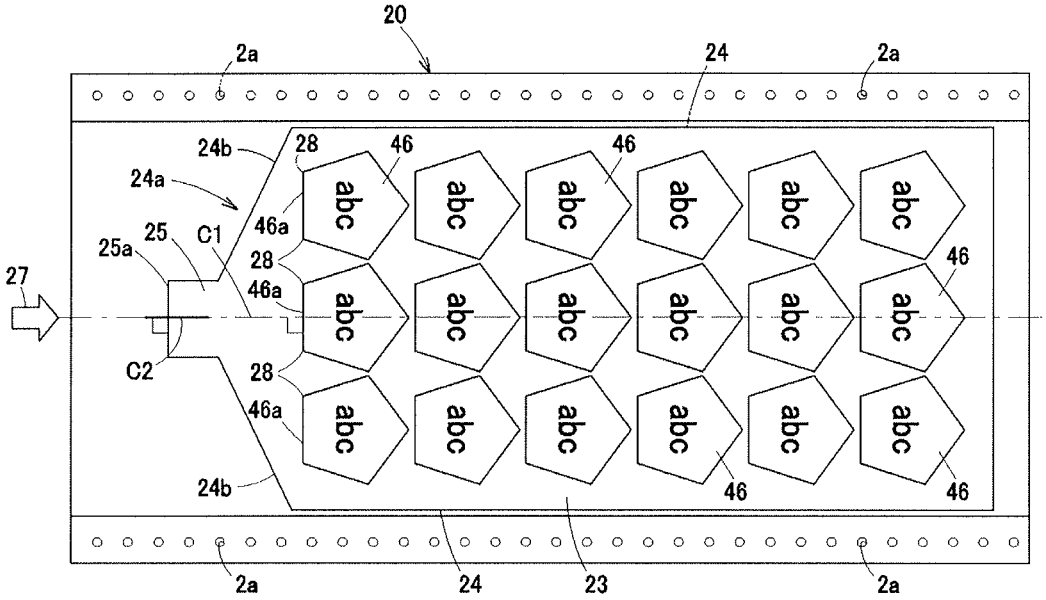
FIG. 14 is a plan view of an eighth modified example with pentagonal label parts.

In an eighth modified example of FIG. 14, a pentagonal label part 46 is provided. The pentagonal label part 46 is arranged so that one side 46*a* parallel with the width direction of the label medium 20 is positioned at the leading-side (the left side in FIG. 14) of the label medium 20 and is substantially perpendicular to the longitudinal direction of the label medium 20. In this case, like the embodiments of FIGS. 3, 5, 8 and 9, the tab part 25 is formed so that the central line C2 thereof in the width direction coincides with the central line C1 passing through the center of the label medium 20 in the width direction. Thereby, the tab part 25 serves as an index, so that the user first peels off the tab part 25 from the release sheet 20*d*, pulls the frame part 23 in the direction shown with the arrow 27 in FIG. 14 and thus peels off the frame part 23 from the release sheet 20*d*. In this way, the peeling force is not concentrated on the two corner portions 28 of the leading-side of each label part 46 and is applied to the one side 46*a*. The one side 46*a* has a larger contact area with the release sheet 20*d* than the corner portions 28. Therefore, in the label medium 20, only the frame part 23 is peeled off from the release sheet 20*d* and the label parts 46 remain on the release sheet 20*d*. As a result, it is possible to prevent the label part 46 from being peeled off with being coupled to the frame part 23, which occurs in the related art.

Figure 15:
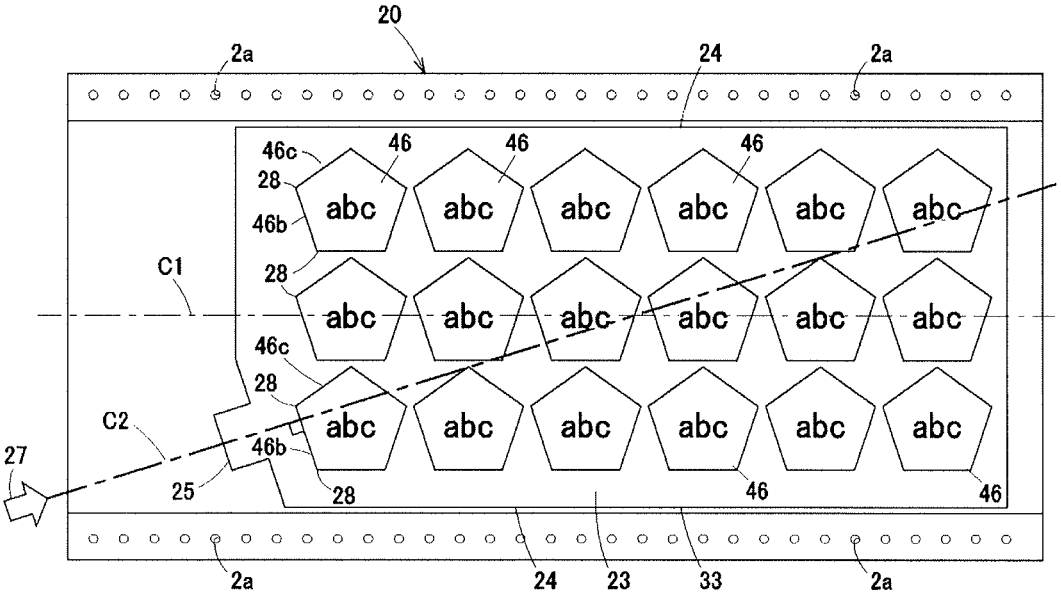
FIG. 15 is a plan view of a ninth modified example with pentagonal label parts.

In a ninth modified example of FIG. 15, sides 46*b*, 46*c* of the pentagonal label part 46 adjacent to the leading-side of the label medium 20 are not parallel with the width direction of the label medium 20. The tab part 25 is formed so that the central line C2 thereof is oblique relative to the central line C1 of the label medium 20 and is substantially perpendicular to the one side 46*b* of the leading-side of the label medium 20. Thereby, the tab part 25 serves as an index, so that the user first peels off the tab part 25 from the release sheet 20*d*, pulls the frame part 23 in the direction shown with the arrow 27 in FIG. 15 and thus peels off the frame part 23 from the release sheet 20*d*. In this way, the peeling force is not concentrated on the corner portion 28 of the leading-side of each label part 46 and is applied to the side 46*b*. Therefore, in the label medium 20, only the frame part 23 is peeled off from the release sheet 20*d* and the label parts 46 remain on the release sheet 20*d*. As a result, it is possible to prevent the label part 46 from being peeled off with being coupled to the frame part 23, which occurs in the related art. In this modified example, even when the tab part 25 is provided to be substantially perpendicular to the side 46*c*, the same effect can be accomplished.

Figure 16:
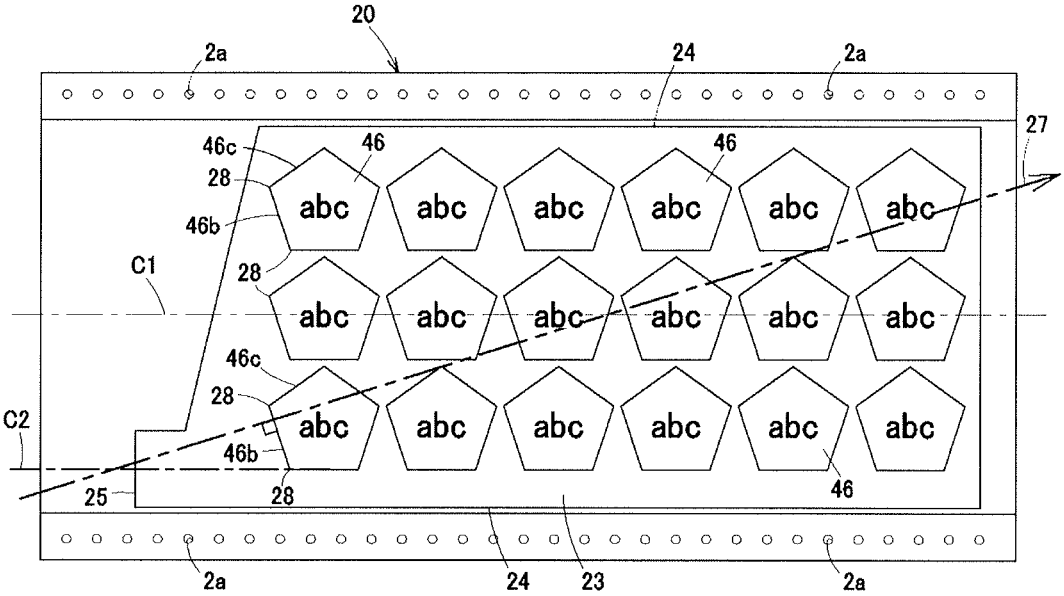
FIG. 16 is a plan view of a tenth modified example with pentagonal label parts.

In a tenth modified example shown in FIG. 16, like FIG. 15, the sides 46*b*, 46*c* of the pentagonal label part 46 adjacent to the leading-side of the label medium 20 are not parallel with the width direction of the label medium 20. The tab part 25 is formed so that the central line C2 thereof is substantially parallel with the central line C1 of the label medium 20, and is provided at the one corner portion-side (the lower side in FIG. 16) of the side of the tip-side. Thereby, the tab part 25 serves as an index, so that the user first peels off the tab part 25 from the release sheet 20*d*, pulls the frame part 23 in the direction substantially perpendicular to the side 46*b* and shown with the arrow 27 in FIG. 16 and thus peels off the frame part 23 from the release sheet 20*d*. In this way, the peeling force is applied to the side 46*b*. Therefore, in the label medium 20, only the frame part 23 is peeled off from the release sheet 20*d* and the label parts 46 remain on the release sheet 20*d*. As a result, it is possible to prevent the label part 46 from being peeled off with being coupled to the frame part 23. Meanwhile, in this modified example, even when the tab part 25 is provided at the other corner portion-side (the upper side in FIG. 16) of the side of the tip-side of the label medium 20, the same effect can be accomplished. In this case, the frame part 23 is pulled in a substantially perpendicular direction to the side 46*c* of the label part 46.

Figure 17:
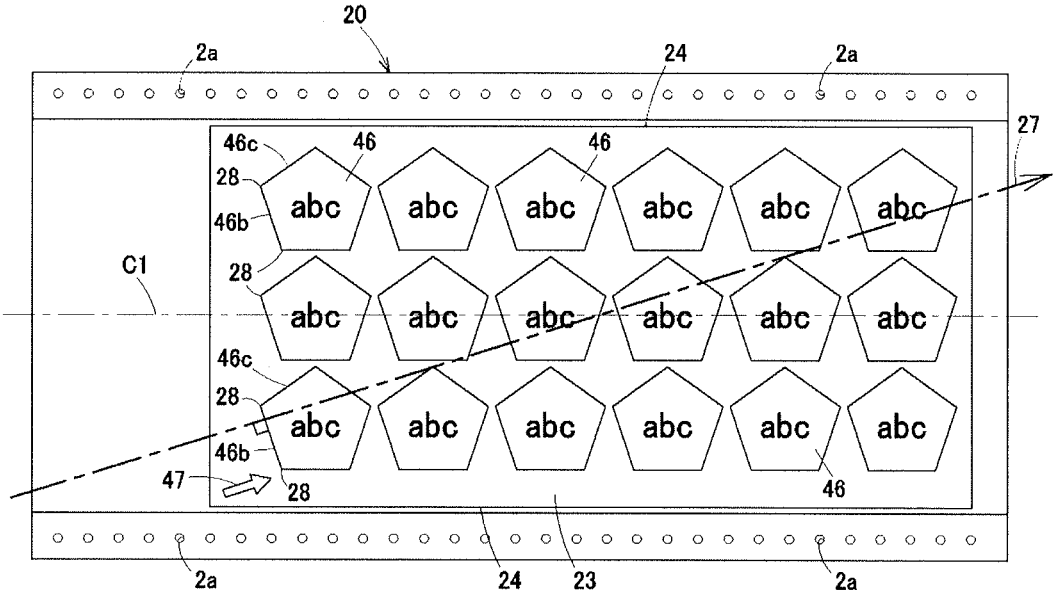
FIG. 17 is a plan view of an eleventh modified example with pentagonal label parts.

In an eleventh modified example shown in FIG. 17, like FIG. 15, the sides 46*b*, 46*c* of the pentagonal label part 46 adjacent to the leading-side of the label medium 20 are not parallel with the width direction of the label medium 20. In the eleventh modified example, the tab part 25 serving as the peeling direction indicating portion is not provided. Instead, all arrow 47 printed substantially at the same time as the printing of the label parts 46 is provided. Thereby, the arrow 47 serves as an index, so that the user first peels off a corner portion adjacent to the arrow 47 from the release sheet 20*d*, pulls the frame part 23 in the direction substantially perpendicular to the side 46*b* and shown with the arrow 47 in FIG. 17 and thus peels off the frame part 23 from the release sheet 20*d*. In this way, the peeling force is applied to the side 46*b*. Therefore, in the label medium 20, only the frame part 23 is peeled off from the release sheet 20*d* and the label parts 46 remain on the release sheet 20*d*. As a result, it is possible to prevent the label part 46 from being peeled off with being coupled to the frame part 23. Meanwhile, in this modified example, even when the arrow 47 is provided at the other corner portion-side (the upper side in FIG. 17) of the side of the tip-side of the label medium 20, the same effect can be accomplished. In this case, the frame part 23 is pulled in a substantially perpendicular direction to the side 46*c*.

Meanwhile, in the above modified examples, the label part 46 having the regular pentagonal shape has been described. However, the respective sides of the pentagon may have different lengths.

7. Twelfth to Fourteenth Modified Examples of Label Medium (Rhombic Examples)

Figure 18:
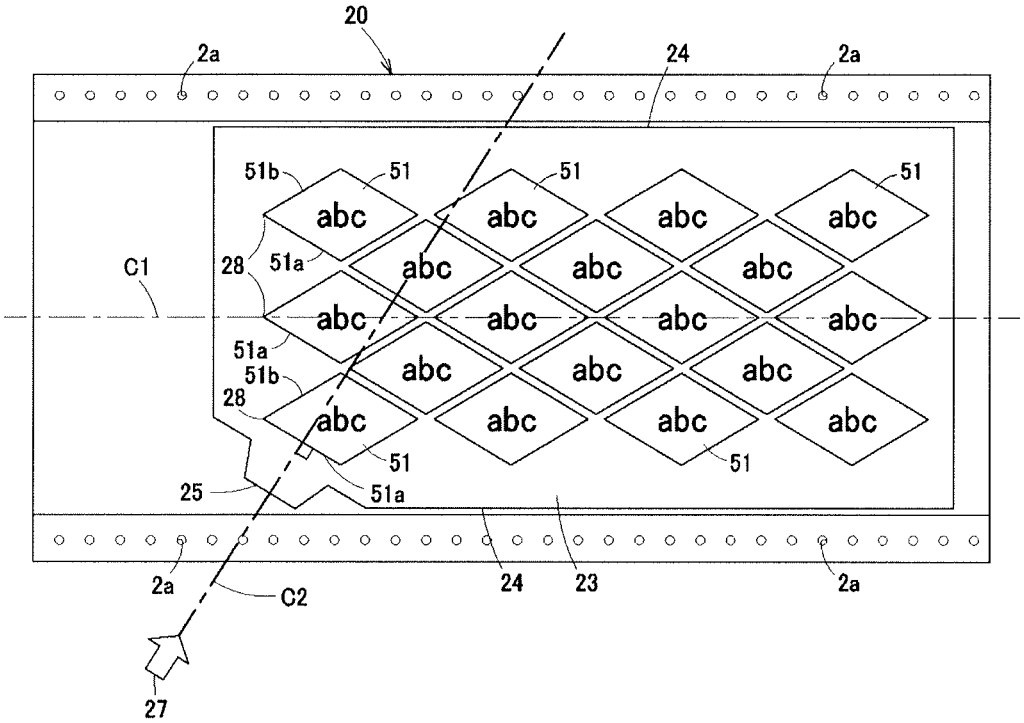
FIG. 18 is a plan view of a twelfth modified example with rhombic label parts.

In a twelfth modified example of FIG. 18, a rhombic label part 51 is provided. Sides 51*a*, 51*b* of the rhombic label part 51 adjacent to the leading-side of the label medium 20 are not parallel with the width direction of the label medium 20. The tab part 25 is formed so that the central line C2 thereof is oblique relative to the central line C1 of the label medium 20 and is substantially perpendicular to one side 51*a* of the leading-side of the label medium 20. Thereby, the tab part 25 serves as an index, so that the user first peels off the tab part 25 from the release sheet 20*d*, pulls the frame part 23 in the direction shown with the arrow 27 in FIG. 18 and thus peels off the frame part 23 from the release sheet 20*d*. In this way, the peeling force is not concentrated on the corner portion 28 of the leading-side of each label part 51 and is applied to the side 51*a*. Therefore, in the label medium 20, only the frame part 23 is peeled off from the release sheet 20*d* and the label parts 51 remain on the release sheet 20*d*. As a result, it is possible to prevent the label part 51 from being peeled off with being coupled to the frame part 23, which occurs in the related art. Meanwhile, in this modified example, even when the tab part 25 is provided to be substantially perpendicular to the side 51*a*, the same effect can be accomplished.

Figure 19:
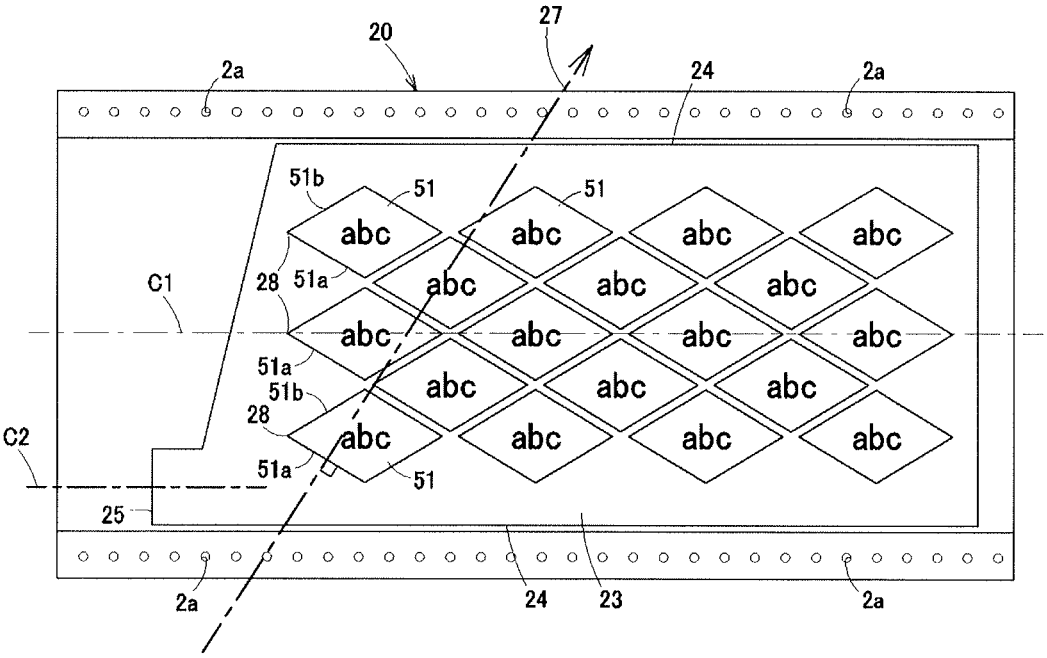
FIG. 19 is a plan view of a thirteenth modified example with rhombic label parts.

In a thirteenth modified example shown in FIG. 19, like FIG. 18, the sides 51*a*, 51*b* of the rhombic label part 51 adjacent to the leading-side of the label medium 20 are not parallel with the width direction of the label medium 20. The tab part 25 is formed so that the central line C2 thereof is substantially parallel with the central line C1 of the label medium 20, and is provided at the one corner portion-side (the lower side in FIG. 19) of the side of the tip-side of the label medium 20. Thereby, the tab part 25 serves as an index, so that the user first peels off the tab part 25 from the release sheet 20*d*, pulls the frame part 23 in the direction substantially perpendicular to the side 51*a* and shown with the arrow 27 in FIG. 19 and thus peels off the frame part 23 from the release sheet 20*d*. In this way, the peeling force is applied to the side 51*a*. Therefore, in the label medium 20, only the frame part 23 is peeled off from the release sheet 20*d* and the label parts 51 remain on the release sheet 20*d*. As a result, it is possible to prevent the label part 51 from being peeled off with being coupled to the frame part 23. Meanwhile, in this modified example, even when the tab part 25 is provided at the other corner portion-side (the upper side in FIG. 19) of the side of the tip-side of the label medium 20, the same effect can be accomplished. In this case, the frame part 23 is pulled in a substantially perpendicular direction to the side 51*c* of the label part 51.

Figure 20:
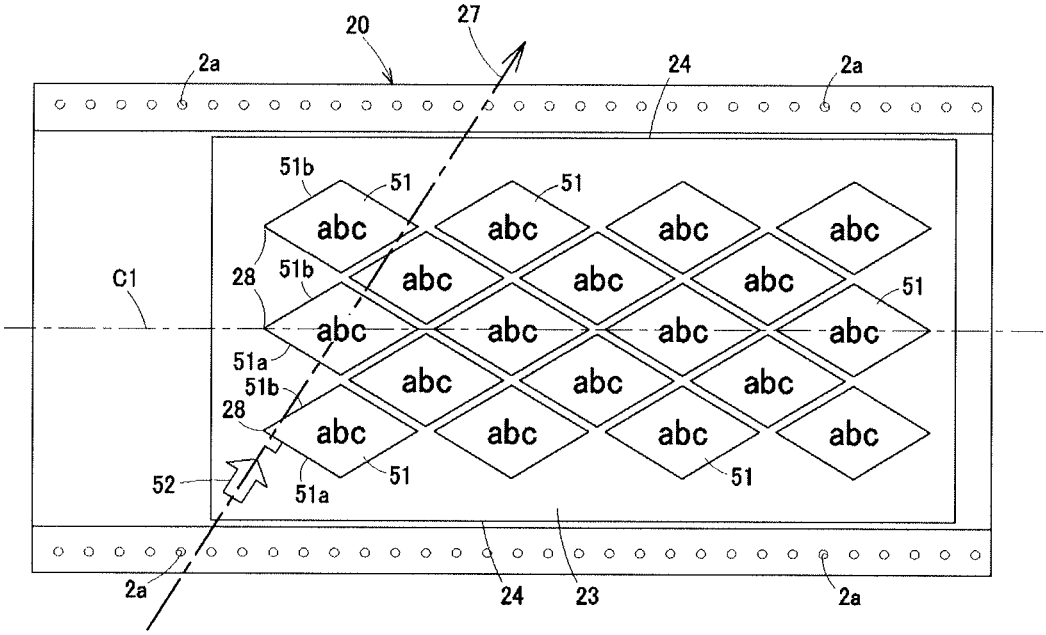
FIG. 20 is a plan view of a fourteenth modified example with rhombic label parts.

In a fourteenth modified example shown in FIG. 20, like FIG. 18, the sides 51*a*, 51*b* of the rhombic label part 51 adjacent to the leading-side of the label medium 20 are not parallel with the width direction of the label medium 20. In the fourteenth modified example, the tab part 25 serving as the peeling direction indicating portion is not provided. Instead, an arrow 52 printed substantially at the same time as the printing of the label parts 51 is provided. Thereby, the arrow 52 serves as an index, so that the user first peels off a corner portion adjacent to the arrow 52 from the release sheet 20*d*, pulls the frame part 23 in the direction substantially perpendicular to the side 51*a* and shown with the arrow 52 in FIG. 20 and thus peels off the frame part 23 from the release sheet 20*d*. In this way, the peeling force is applied to the side 51*a*. Therefore, in the label medium 20, only the frame part 23 is peeled off from the release sheet 20*d* and the label parts 51 remain on the release sheet 20*d*. As a result, it is possible to prevent the label part 51 from being peeled off with being coupled to the frame part 23. Meanwhile, in this modified example, even when the arrow 52 is provided at the other corner portion-side (the upper side in FIG. 20) of the side of the tip-side of the label medium 20, the same effect can be accomplished. In this case, the frame part 23 is pulled in a substantially perpendicular direction to the side 51*b*.

8. Fifteenth to Eighteenth Modified Examples of Label Medium (Other Shapes)

Figure 21:
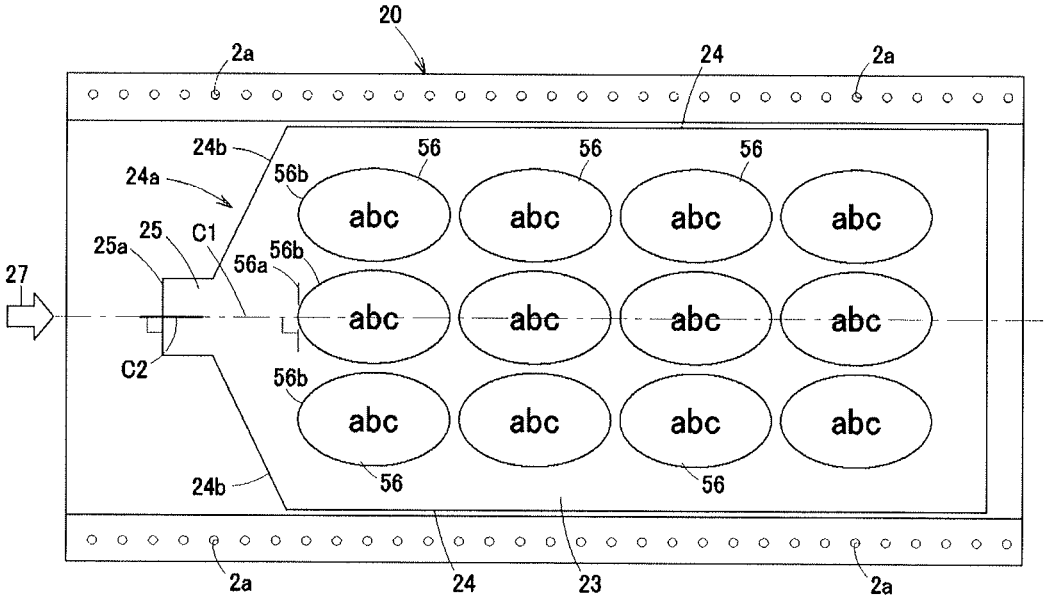
FIG. 21 is a plan view of a fifteenth modified example with elliptical label parts.

In a fifteenth modified example of FIG. 21, an elliptical label part 56 is provided. The elliptical label part 56 is arranged so that a long axis thereof is substantially parallel with the longitudinal direction of the label medium 20. That is, the elliptical label part 56 is arranged so that a tangent line 56*a* of a point intersecting with the long axis of the label part 56 existing on a side 56*b* of the leading-side of the label medium 20 is substantially perpendicular to the longitudinal direction of the label medium 20. In this case, like the embodiments of FIGS. 3, 5, 8 and 9, the tab part 25 is formed so that the central line C2 thereof in the width direction coincides with the central line C1 passing through the center of the label medium 20 in the width direction. Thereby, the tab part 25 serves as an index, so that the user first peels off the tab part 25 from the release sheet 20*d*, pulls the frame part 23 in the direction shown with the arrow 27 in FIG. 21 and thus peels off the frame part 23 from the release sheet 20*d*. In this way, the peeling force is applied to the side 56*b* of the elliptical label part 56 at the leading-side of the label medium 20. Therefore, in the label medium 20, only the frame part 23 is peeled off from the release sheet 20*d* and the label parts 56 remain on the release sheet 20*d*. As a result, it is possible to prevent the label part 56 from being peeled off with being coupled to the frame part 23, which occurs in the related art.

Figure 22:
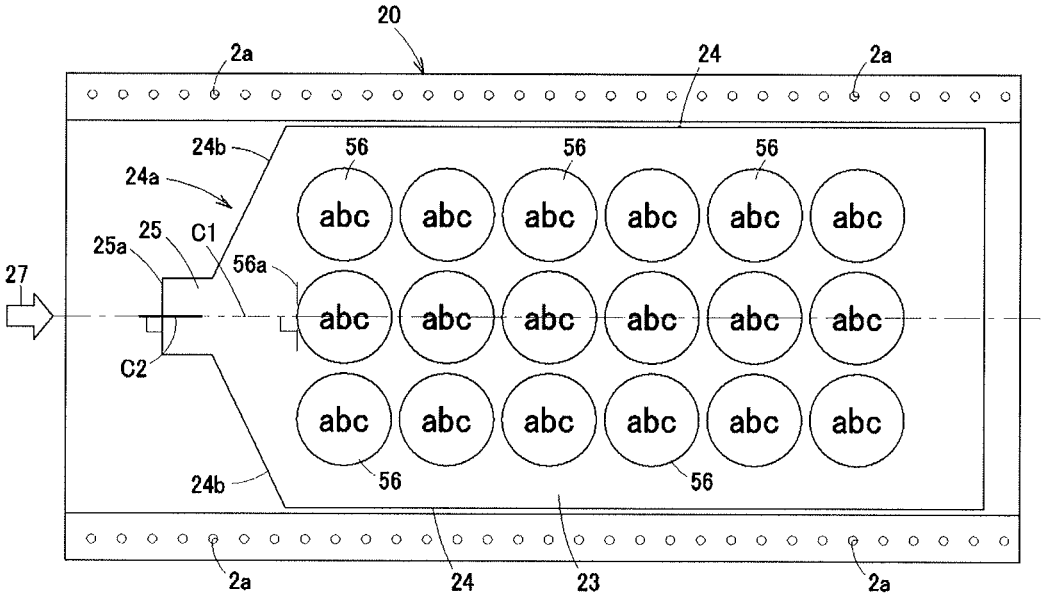
FIG. 22 is a plan view of a sixteenth modified example with true circular label parts.

The label part 56 may be arranged so that a short axis thereof is substantially parallel with the longitudinal direction of the label medium 20. That is, the elliptical label part 56 of FIG. 21 may be rotated by 90°. Further, like a sixteenth modified example shown in FIG. 22, the label part 56 may have a true circular shape. Meanwhile, in the embodiments of FIGS. 21 and 22, since the label part 56 has the elliptical or true circular shape and the outline thereof is a curved line, the tab part 25 may be provided at any one corner portion-side (the upper or lower side in FIG. 21) of the side of the tip-side of the label medium 20. Also, a printed arrow may be provided as the peeling direction indicating portion, instead of the tab part 25.

Figure 23:
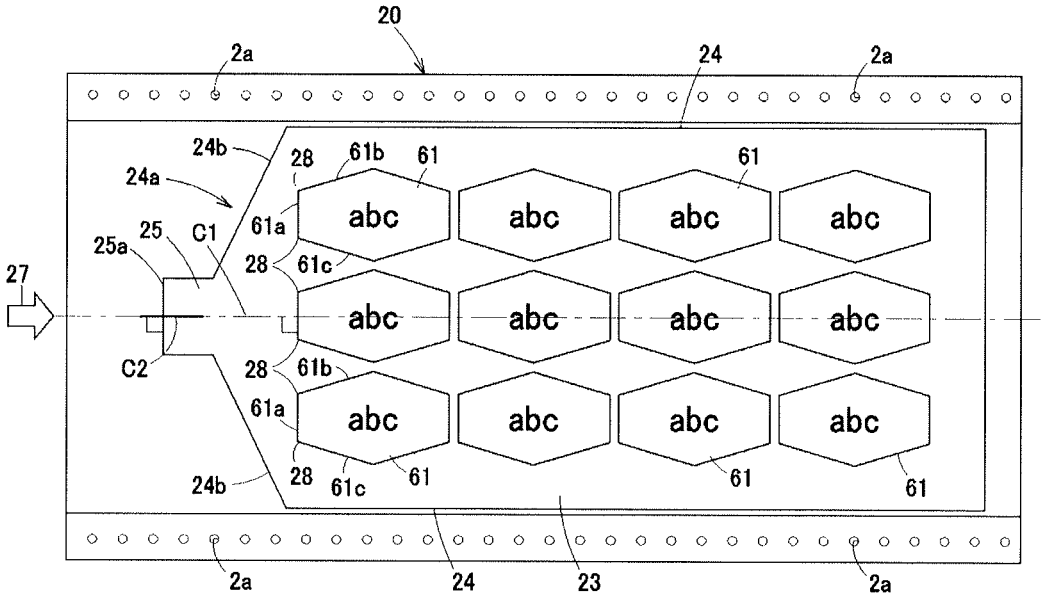
FIG. 23 is a plan view of a seventeenth modified example with hexagonal label parts.

Further, in a seventeenth modified example of FIG. 23, a hexagonal label part 61 is provided. The hexagonal label part 61 is arranged so that one side 61*a* parallel with the width direction of the label medium 20 is positioned at the leading-side (the left side in FIG. 23) of the label medium 20 and is substantially perpendicular to the longitudinal direction of the label medium 20. In this case, the tab part 25 is formed so that the central line C2 thereof in the width direction coincides with the central line C1 passing through the center of the label medium 20 in the width direction. Thereby, the tab part 25 serves as an index, so that the user first peels off the tab part 25 from the release sheet 20*d*, pulls the frame part 23 in the direction shown with the arrow 27 in FIG. 23 and thus peels off the frame part 23 from the release sheet 20*d*. In this way, the peeling force is not concentrated on the corner portions 28 of the leading-side of each label part 61 and is applied to the one side 61*a*. The one side 61*a* has a larger contact area with the release sheet 20*d* than the corner portions 28. Therefore, in the label medium 20, only the frame part 23 is peeled off from the release sheet 20*d* and the label parts 61 remain on the release sheet 20*d*. As a result, it is possible to prevent the label part 61 from being peeled off with being coupled to the frame part 23, which occurs in the related art.

The tab part 25 serving as the peeling direction indicating portion may be provided at a position perpendicular to inclined sides 61*b*, 61*c* of the hexagon at the tip-side of the label medium 20 or may be a printed arrow. Also, although the hexagonal label part 61 has been here described, the hexagonal shape may be a regular hexagonal shape or respective sides thereof may have different lengths.

Figure 24:
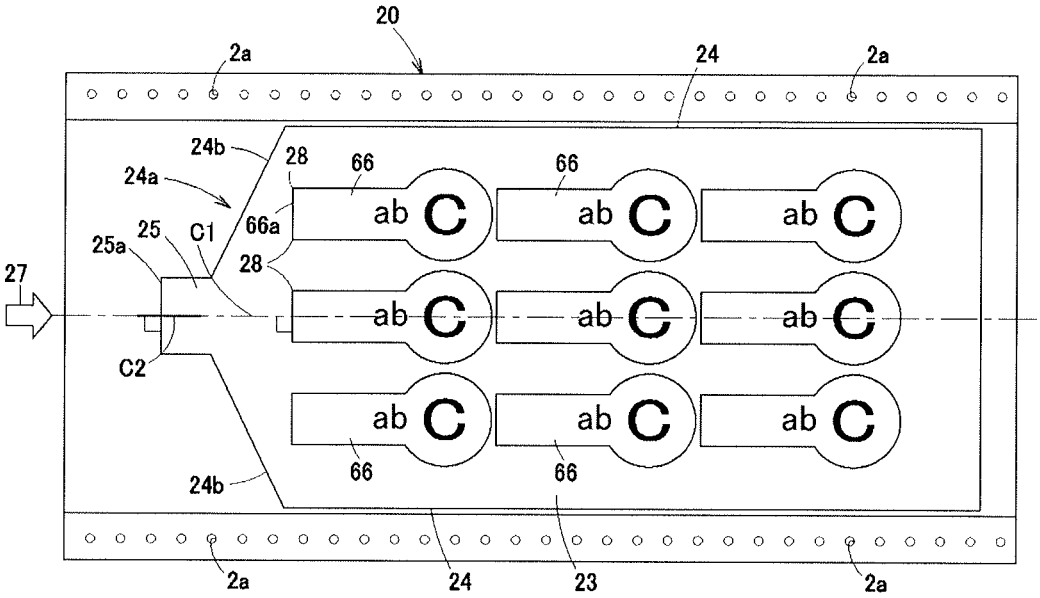
FIG. 24 is a plan view of an eighteenth modified example with label parts having a combination of rectangular and true circular shapes.

Further, in an eighteenth modified example of FIG. 24, a label part 66 is configured such that a rectangular portion is formed at the leading-side of the label medium 20 and a circular portion is formed at an opposite side. The label part 66 is arranged so that one side 66*a* of the rectangular portion parallel with the width direction of the label medium 20 is positioned at the leading-side (the left side in FIG. 24) of the label medium 20 and is substantially perpendicular to the longitudinal direction of the label medium 20. In this case, the tab part 25 is formed so that the central line C2 thereof in the width direction coincides with the central line C1 passing through the center of the label medium 20 in the width direction. Thereby, the tab part 25 serves as an index, so that the user first peels off the tab part 25 from the release sheet 20*d*, pulls the frame part 23 in the direction shown with the arrow 27 in FIG. 24 and thus peels off the frame part 23 from the release sheet 20*d*. In this way, the peeling force is not concentrated on the corner portions 28 of the leading-side of each label part 66 and is applied to the one side 66*a*. The one side 66*a* has a larger contact area with the release sheet 20*d* than the corner portions 28. Therefore, in the label medium 20, only the frame part 23 is peeled off from the release sheet 20*d* and the label parts 66 remain on the release sheet 20*d*. As a result, it is possible to prevent the label part 66 from being peeled off with being coupled to the frame part 23, which occurs in the related art. A printed arrow may be used as the peeling direction indicating portion, instead of the tab part 25.

9. Nineteenth and Twentieth Modified Examples of Label Medium

Figure 25:
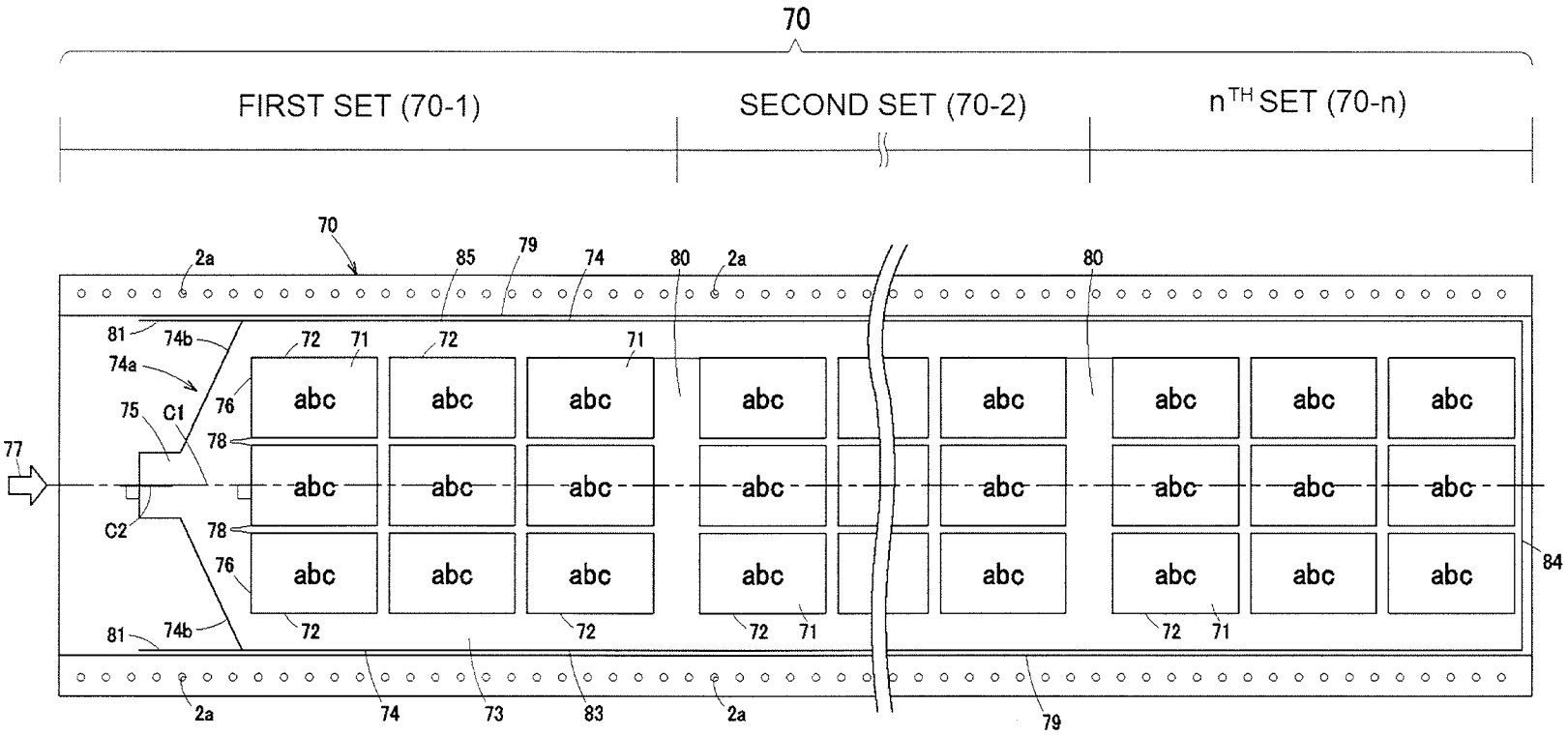
FIG. 25 is a plan view of a nineteenth modified example in which copies of a set of label parts are sequentially printed in a longitudinal direction.

In a label medium 70 of FIG. 25 according to a nineteenth modified example, three label parts 71 are aligned in the vertical direction and in the horizontal direction, respectively, which configure one group 70-1, and copies of the one group 70-1 are sequentially provided in the longitudinal direction (n copies are provided in the embodiment of FIG. 25). An outline 72 of the label part 71 of each group 70-1 to 70-n is half-cut. A part of the label medium 70 other than the label parts 71 forms a frame part 73 provided outside the label parts 71. An outline 74 of the frame part 73 is formed at a slight inner side of an outer edge part of the label medium 70 in the longitudinal direction of the label medium 70. Also, a leading part 74*a* of the outline 74 is provided with inclined sides 74*b*, 74*b* inclined from both sides of the outline 74 towards a central part, and the central part is formed with a tab part 75 becoming a peeling direction indicating portion configured to indicate a peeling direction in which the frame part 73 is peeled off from the release sheet 20*d*. The outline 74 of the frame part 73 is also half-cut. Here, the one outline 74 is formed to surround all the groups 70-1 to 70-n, and a blank part 80 becoming a border part configured to partition the groups is provided between the respective groups and is not half-cut. Also, the outline 74 is formed with extension lines 81 at both ends of the outline 74 facing the tip-side of the label medium 70.

The tab part 75 provided at the leading part 74*a* of the label medium 70 is formed so that the central line C2 passing through a center thereof in the width direction coincides with the central line C1 passing through a center of the label medium 70 in the width direction. Also, the tab part 75 is formed to be substantially perpendicular to a leading side 76 of each aligned label part 71 in the width direction. That is, the tab part 75 further protruding between the inclined surfaces 74*b*, 74*b* inclined towards a tip of the label medium 70 is formed, so that the tab part 75 can urge a user to intuitively start peeling off the frame part 73 from the tab part 75. That is, the tab part 75 serves as an index, so that the user first peels off the tab part 75 from the release sheet 20*d*, pulls the frame part 73 in a direction shown with an arrow 77 in FIG. 25 and thus peels off the frame part 73 from the release sheet 20*d*. That is, the frame part 73 is peeled off from the release sheet 20*d* in order of the groups 70-1, 70-2, . . . , 70-n.

In this way, the peeling force is not concentrated on corner portions 78, 78 of the leading-side of each label part 71 and is applied to the one side 76 of the label medium 70 in the width direction. The one side 76 has a larger contact area with the release sheet 20*d* than the corner portions 78, 78. Therefore, in the label medium 70, even if the adhesive layer 20*b* of the label part 71 and the adhesive layer 20*b* of the frame part 73 are adhered to each other, only the frame part 73 is peeled off from the release sheet 20*d* and the label parts 71 remain on the release sheet 20*d*. As a result, it is possible to prevent the label part 71 from being peeled off with being coupled to the frame part 73, which occurs in the related art. A relation between the tab part 75 and the one side 76 is not necessarily strictly perpendicular and may slightly deviate from the perpendicular state.

Half-cutting lines 79 configured to separate an inner printing region and a line of the sprocket holes 2*a* are formed in parallel with each other at the inner side of the sprocket holes 2*a*. There is also a label medium 70 in which the halt cutting lines 79 are not provided and the adhesive sheet 20*c* is formed on the entire release sheet 20*d*. Also, the region in which the sprocket holes 2*a* are arranged is a region in which the half-cutting cannot be performed for the adhesive sheet 20*c* by the cutting tool 7*a*, and sides 83, 85 are necessarily formed when forming the frame part 73.

In the below, a sequence of cutting the label medium 70 by the printer 1 is described with reference to FIG. 26. First, the controller 10 lowers the cutting tool 7*a* of the first cutting mechanism 7 and presses the same to a starting position of the label medium 70 with a predetermined pressure. Here, the starting position is a tip portion 82 of the one extension line 81. Then, the controller 10 drives the driving motor of the feeding mechanism in the forward direction and rotates the sprocket 2 in the forward direction, thereby moving the label medium 70 in the arrow R direction of FIG. 1. Thereby, the one extension line 81 is half-cut (see (1) in FIG. 26).

Figure 26:
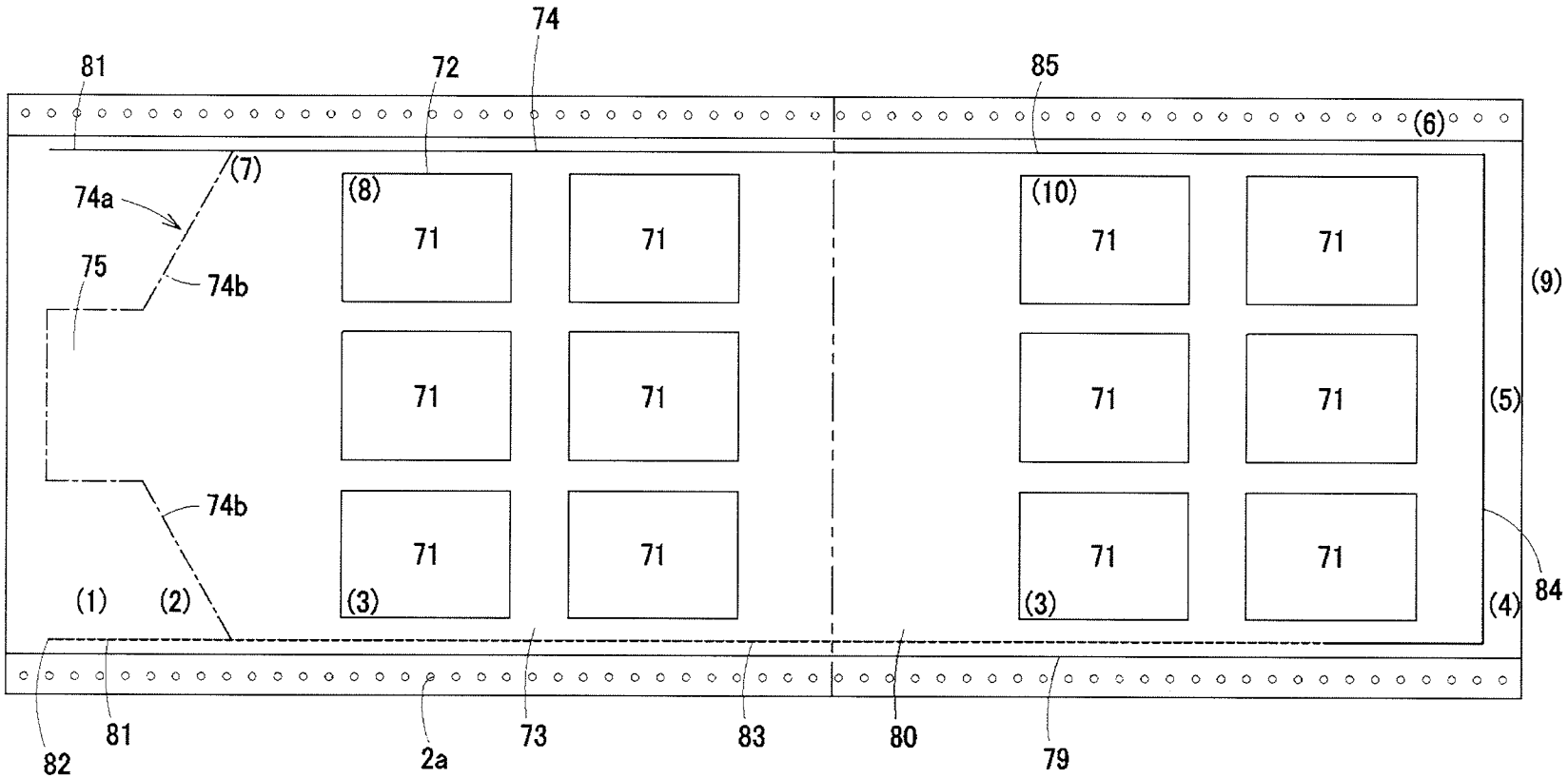
FIG. 26 is a diagram illustrating a sequence of cutting operations for the label medium according to the nineteenth modified example of FIG. 25.

At the same time or before or after the above processing, the controller 10 lowers the thermal head 3 to press the label medium 70 to the platen 4 (see (2) in FIG. 26). At this time, the controller 10 does not supply the print data to the thermal head 3 and does not print anything on the label medium 70. Then, when the label medium 70 is conveyed to a print starting position of the print data, the controller 10 supplies the thermal energy corresponding to the print data to the thermal head 3, thereby printing a letter and the like on the label medium 70 (see (3) in FIG. 26). In this period, the cutting tool 7*a* continues to half-cut the one side 83 of the outline 74 of the frame part 83. That is, the cutting tool 7*a* half-cuts the one side 83 over the substantially entire length of the groups 70-1 to 70-n. Thereby, upon the print starting, the label medium 70 is already applied with a load for the half-cutting by the cutting tool 7*a* and a load of the thermal head 3. Also, even during the printing, the corresponding state is not changed and the load is not varied. Therefore, it is possible to prevent a printing non-uniformity from being generated due to the variation in the feeding speed of the label medium 70 during the printing.

When the printing period is over, the controller 10 raises the thermal head 3 and separates the same from the label medium 70 (see (4) in FIG. 26). Then, the controller 10 drives the driving motor of the first cutting mechanism 7 to move the cutting tool 7*a* in the width direction of the label medium 70, thereby half-cutting a side 84 of the frame part 73 in the width direction (see (5) in FIG. 26). After that, the controller 10 drives the driving motor of the feeding mechanism in the reverse direction, thereby reversely conveying the label medium 70 in the opposite direction to the arrow R in FIG. 1. Thereby, the cutting tool 7*a* half-cuts the side 85 of the frame part 93 and the extension line 81 continuing from the side 85 (see (6) in FIG. 26). That is, the cutting tool 7*a* half-cuts the side 85 over the substantial length of the groups 70-n to 70-1 in order from the rear group 70-n. The extension line 81 continuing from the side 85 may not be formed.

Thereafter, the controller 10 half-cuts the leading part 74*a* including the tab part 75 of the label medium 70 by the cutting tool 7*a*. Specifically, the controller 10 controls the driving motor of the feeding mechanism and the driving motor of the first cutting mechanism 7 to reversely or forwardly feed the label medium 70 and to move the cutting tool 7*a* in the width direction of the label medium 70, thereby half-cutting the inclined sides 74*b*, 74*b* and the tab part 75 (see (7) in FIG. 26).

When the half-cutting for the outline 74 of the frame part 73 and the leading part 74*a* is completed, the controller 10 moves the label medium 70 for which the printing has been completed in the forward direction, and raises and lowers the cutting tool 7*a* to perform the half-cutting for the outline 72 from the label parts 71 of the top group 70-1 (see (8) in FIG. 26). When the half-cutting for the label part 71 of the final group 70-n is completed, the controller 10 drives the second cutting mechanism 8 to fully cut an end of the final group 70-n of the label medium 70 over the entire width (see (9) in FIG. 26).

According to the processing of the printer 1 as described above, when half-cutting the outline 74 of the frame part 73, the printing of the label parts 71 is also performed. Therefore, it is possible to shorten the overall time after the printing starts until the label medium 70 is discharged. Also, according to the related art, the half-cutting of the outline 74 is performed after the printing of the label parts 71 is over. Thus, the printing is performed so that an extra load other than the load applied to the label medium 70 from the thermal head 3 is not applied as much as possible. However, according to the printer 1, the half-cutting by the cutting tool 7*a* is continuously performed before the start of the printing until the printing is over. Therefore, it is possible to remove the variation in the load and the variation in the feeding speed of the label medium 70 during the printing and to thus prevent an image quality from being deteriorated due to the printing non-uniformity of the label parts 71. Further, since the tab part 75 is not provided for the second and later groups 70-2 to 70-n, it is possible to shorten the overall time after the printing starts until the label medium 70 is discharged. Also, according to the label medium 70, the full cutting is not performed over the entire width for each group, i.e., at the position of the blank part 80. Also in this respect, it is possible to shorten the overall time after the printing starts until the label medium 70 is discharged. Furthermore, even when the plurality of copies is continuously output, it is possible to reduce the number of peeling times of the frame part 73 because the frame part 73 is one.

Like the label medium 70 of a twentieth modified example shown in FIG. 27, the blank part 80 as a border part between the second and later groups 70-2 to 70-n may be formed with the tab part 75 at a leading part of the corresponding group. In this case, when the label medium 70 discharged from the printer 1 is too lengthy and is difficult to handle and thus the blank part 80 is cut over the entire width by the scissors, the tab part 75 is formed at the second group 70-2 and thereafter. Accordingly, the user can avoid lowering the operation efficiency due to the label part 71 being coupled to the frame part 73 and thus peeled off with being in each divided group. In the twentieth modified example, the frame part 73 may be peeled off in each group without fully cutting the label medium 70 in the width direction.

10. Twenty-First and Twenty-Second Modified Examples of Label Medium

Figure 28:
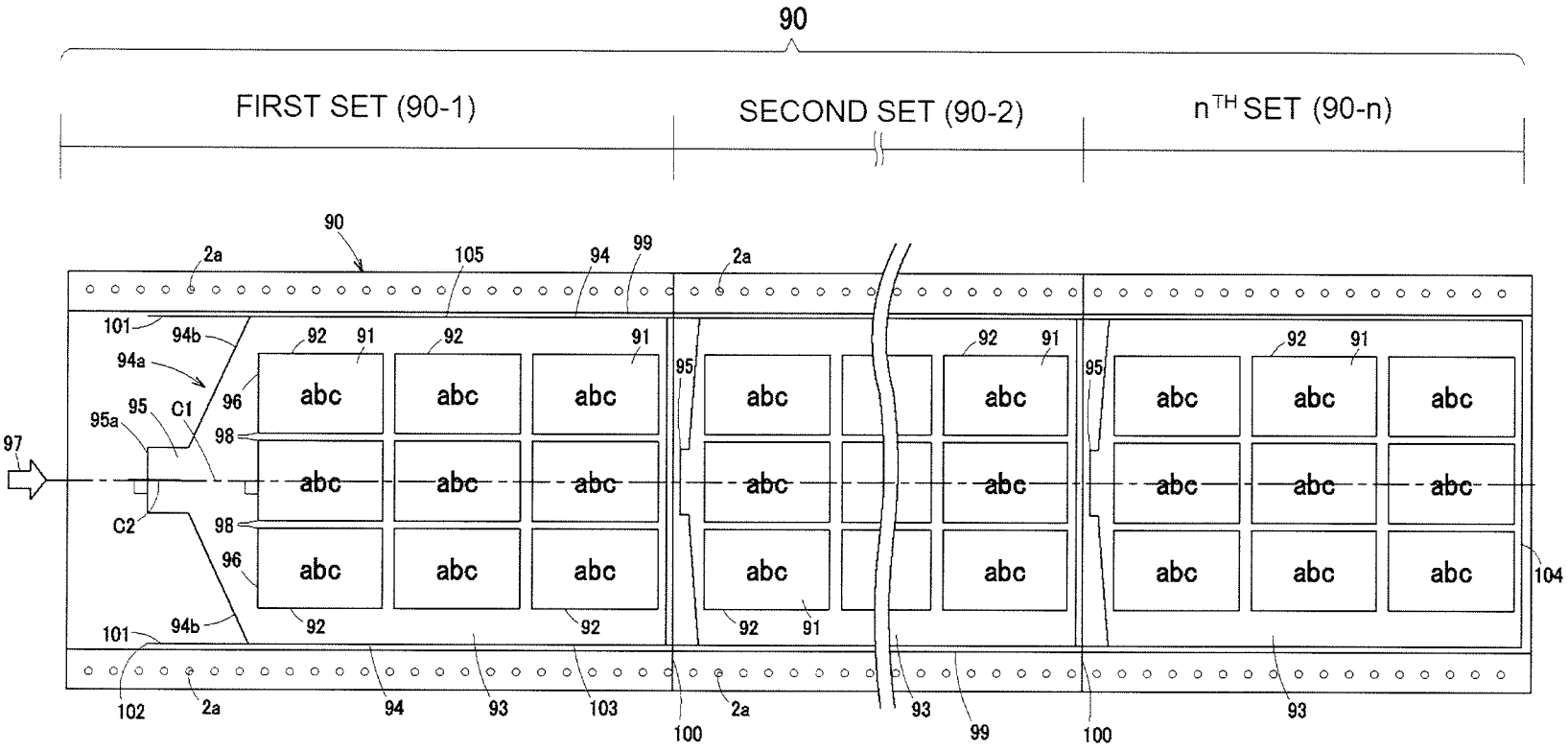
FIG. 28 is a plan view of a twenty-first modified example in which copies of a set of label parts are sequentially printed in a longitudinal direction.

In a label medium 90 of FIG. 28 according to a twenty-first modified example, three label parts 91 are aligned in the vertical direction and in the horizontal direction, respectively, which configure one group 90-1, and copies of the one group 70-1 are sequentially provided in the longitudinal direction (n copies are provided in the embodiment of FIG. 28). An outline 92 of each label part 91 of each group 90-1 to 90-n is half-cut. A part other than the label parts 91 of each group 90-1 to 90-n forms a frame part 93 provided outside the label parts 91. An outline 94 of the frame part 93 of each group 90-1 to 90-n is formed at a slight inner side of an outer edge part of the label medium 90 in the longitudinal direction of the label medium 90. Also, a leading part 94*a* of the outline 94 of each group 90-1 to 90-n is provided with inclined sides 94*b*, 94*b* inclined from both sides towards a central part, and the central part is formed with a tab part 95 becoming a peeling direction indicating portion configured to indicate a peeling direction in which the frame part 93 is peeled off from the release sheet 20*d*. The outline 94 of the frame part 93 of each group 90-1 to 90-n is also half-cut. Here, the outline 94 is formed with extension lines 101 at both ends of the outline 94 facing the tip-side of the label medium 90.

Half-cutting lines 99 configured to separate an inner printing region and a line of the sprocket holes 2*a* are formed in parallel with each other at the inner side of the sprocket holes 2*a*. There is also a label medium 70 in which the halt cutting lines 99 are not provided and the adhesive sheet 20*c* is formed on the entire release sheet 20*d*. Also, the region in which the sprocket holes 2*a* are arranged is a region in which the half-cutting cannot be performed for the adhesive sheet 20*c* by the cutting tool 7*a*, and sides 103, 105 are necessarily formed when forming the frame part 93.

The tab part 95 provided at the leading part 94*a* of each group 90-1 to 90-n is formed so that the central line C2 passing through a center thereof in the width direction coincides with the central line C1 passing through a center of the label medium 90 in the width direction. Also, the tab part 95 is formed to be substantially perpendicular to a leading side 96 of each aligned label part 91 in the width direction. That is, the tab part 95 further protruding between the inclined surfaces 94*b*, 94*b* inclined towards a tip of each group 90-1 to 90-n is formed, so that the tab part 95 of each group 90-1 to 90-n can urge a user to intuitively start peeling off the frame part 93 from the tab part 95. The label medium 90 is discharged from the printer 1 one group by one group by the second cutting mechanism 8 after the printing of each group 90-1 to 90-n is completed and the half-cutting of the outlines 92, 94 is completed. The tab part 95 serves as an index, so that the user first peels off the tab part 95 from the release sheet 20*d*, pulls the frame part 93 in a direction shown with an arrow 97 in FIG. 28 and thus peels off the frame part 93 from the release sheet 20*d*, when using each divided group.

In this way, the peeling force is not concentrated on corner portions 98, 98 of the leading-side of each label part 71 of each group 90-1 to 90-n and is applied to the one side 96 of the label medium 90 in the width direction. The one side 96 has a larger contact area with the release sheet 20*d* than the corner portions 98, 98. Therefore, in the label medium 90, even if the adhesive layer 20*b* of the label part 91 and the adhesive layer 20*b* of the frame part 93 are adhered to each other, only the frame part 93 is peeled off from the release sheet 20*d* and the label parts 91 remain on the release sheet 20*d*. As a result, it is possible to prevent the label part 91 from being peeled off with being coupled to the frame part 93, which occurs in the related art. A relation between the tab part 95 and the one side 96 is not necessarily strictly perpendicular and may slightly deviate from the perpendicular state.

Figure 29:
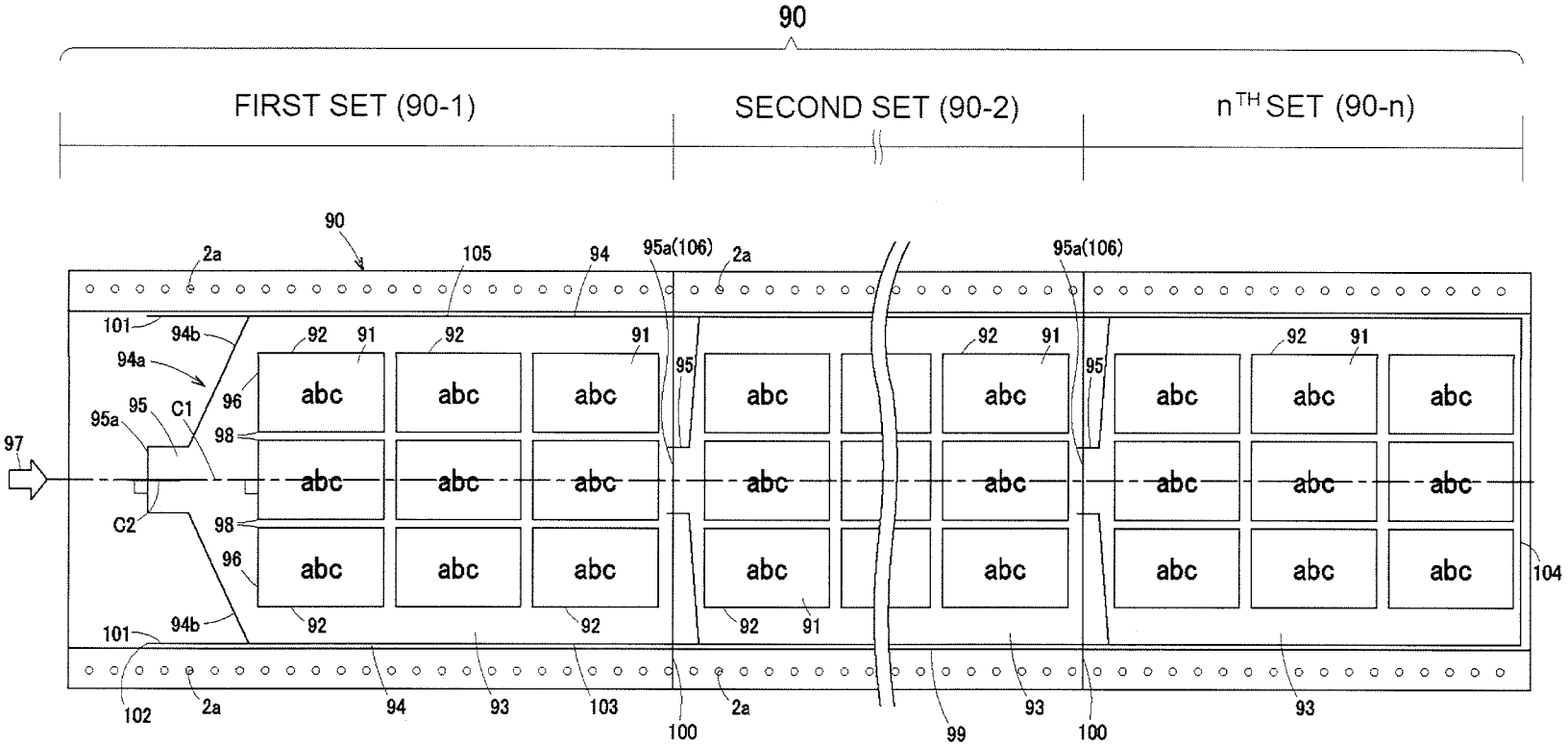
FIG. 29 is a plan view of a twenty-second modified example in which copies of a set of label parts are sequentially printed in a longitudinal direction.

As shown in FIG. 29, an additional side 106, which connects tip portions of the extension lines 101, 101 continuing from the sides 103, 105 of the frame part 93 in the second and later groups 90-2 to 90-n, may be half-cut and may be made to coincide with a side 95*a* of the tab part 95 in the width direction.

In the below, a sequence of cutting the label medium 90 by the printer 1 is described with reference to FIG. 30. First, the controller 10 lowers the cutting tool 7*a* of the first cutting mechanism 7 and presses the same to a starting position of the label medium 90 with a predetermined pressure. Here, the starting position is a tip portion 102 of the one extension line 101. Then, the controller 10 drives the driving motor of the feeding mechanism in the forward direction and rotates the sprocket 2 in the forward direction, thereby moving the label medium 90 in the arrow R direction of FIG. 1. Thereby, the one extension line 101 is half-cut (see (1) in FIG. 30).

Figure 30:
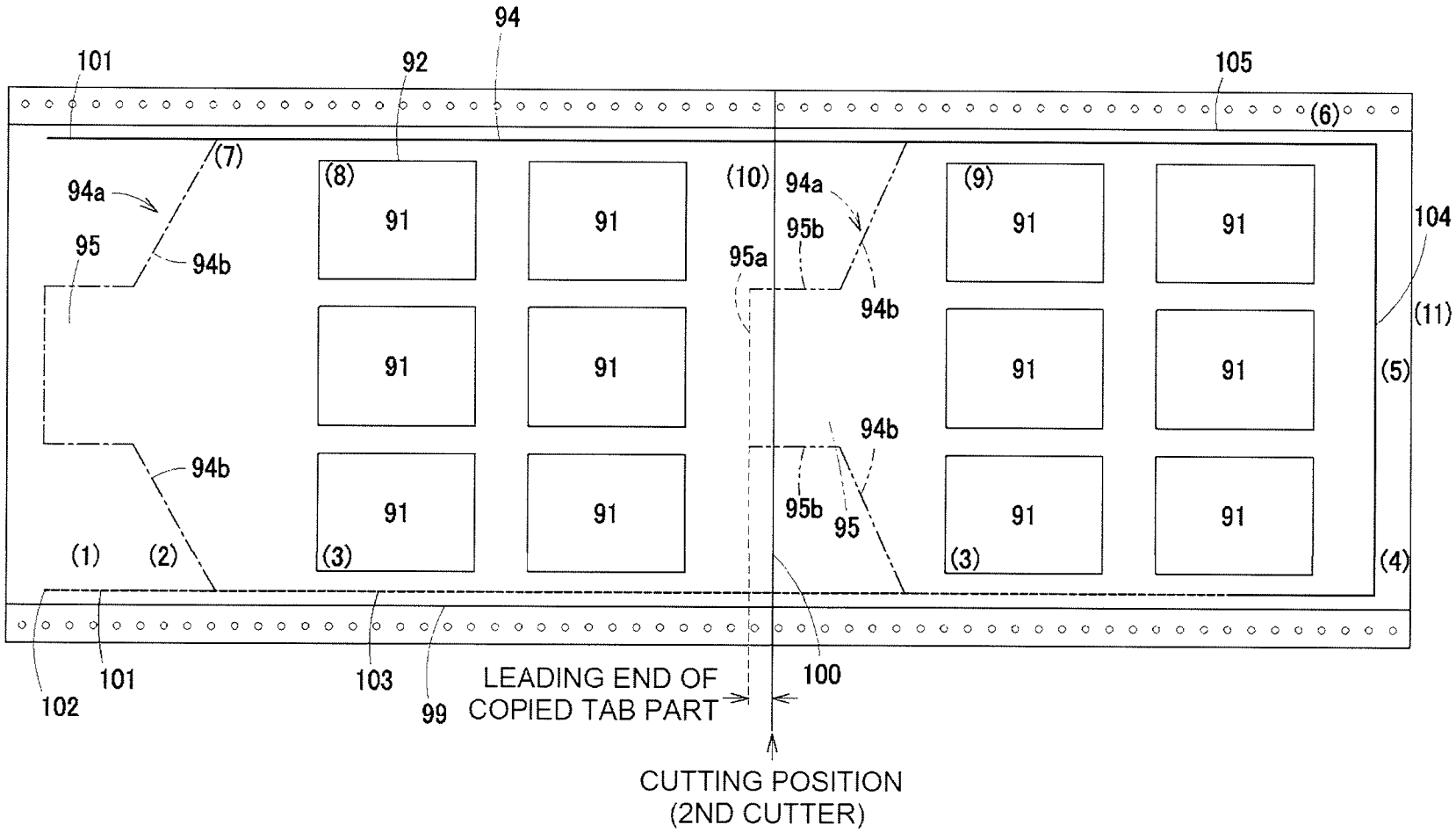
FIG. 30 is a diagram illustrating a sequence of cutting operations for the label medium according to the twenty-second modified example of FIG. 28.

At the same time or before or after the above processing, the controller 10 lowers the thermal head 3 to press the label medium 90 to the platen 4 (see (2) in FIG. 30). At this time, the controller 10 does not supply the print data to the thermal head 3 and does not print anything on the label medium 90. Then, when the label medium 90 is conveyed to a print starting position of the print data and the conveying speed of the label medium 90 becomes a constant speed conveyance state, the controller 10 supplies the thermal energy corresponding to the print data to the thermal head 3, thereby printing a letter and the like on the label medium 90 (see (3) in FIG. 30). In this period, the cutting tool 7*a* continues to half-cut the one side 103 of the outline 94 of the frame part 93. That is, the cutting tool 7*a* half-cuts the one side 103 over the substantially entire length of the groups 90-1 to 90-n. Thereby, upon the print starting, the label medium 90 is already applied with a load for the half-cutting by the cutting tool 7*a* and a load of the thermal head 3. Also, even during the printing at the constant speed conveyance state, the corresponding state is not changed and the load is not varied. Therefore, it is possible to prevent a printing non-uniformity from being generated due to the variation in the feeding speed of the label medium 90 during the printing.

When the printing period is over, the controller 10 raises the thermal head 3 and separates the same from the label medium 90. In this state, the half-cutting by the cutting tool 7*a* continues (see (4) in FIG. 30). Then, the controller 10 drives the driving motor of the first cutting mechanism 7 to move the cutting tool 7*a* in the width direction of the label medium 90, thereby half-cutting a side 104 of the frame part 93 in the width direction (see (5) in FIG. 30). After that, the controller 10 drives the driving motor of the feeding mechanism in the reverse direction, thereby reversely conveying the label medium 90 in the opposite direction to the arrow R in FIG. 1. Thereby, the cutting tool 7*a* half-cuts the side 105 of the frame part 93 and the extension line 101 continuing from the side 105 (see (6) in FIG. 30). That is, the cutting tool 7*a* half-cuts the side 105 over the substantial length of the groups 90-n to 90-1 in order from the rear group 90-n. The extension line 101 continuing from the side 105 may not be formed.

Thereafter, the controller 10 half-cuts the leading part 94*a* including the tab part 95 of the label medium 90 by the cutting tool 7*a*. Specifically, the controller 10 controls the driving motor of the feeding mechanism and the driving motor of the first cutting mechanism 7 to reversely or forwardly feed the label medium 90, to raise and lower the cutting tool 7*a* and to move the cutting tool 7*a* in the width direction of the label medium 90, thereby half-cutting the inclined sides 94*b*, 94*b* and the tab part 95 (see (7) in FIG. 30).

When the half-cutting for the outline 94 of the frame part 93 and the leading part 94*a* is completed, the controller 10 moves the label medium 90 for which the printing has been completed in the forward direction, and raises and lowers the cutting tool 7*a* to perform the half-cutting for the outline 92 from the label parts 91 of the top group 90-1 (see (8) in FIG. 30). Then, the controller 10 half-cuts the inclined sides 94*b*, 94*b* and the tab part 95 of the second group 90-2 (see (9) in FIG. 30). The half-cutting for the leading part 94*a* is performed up to for the final group 90-n. Here, in the second and later groups 90-2 to 90-n, the tab part 95 is configured such that half-cutting lines 95*b*, 95*b* thereof intersect with a cutting line 100 for complete cutting along the width direction. Thereby, it is possible to prevent the cutting from remaining without being performed.

When the half-cutting for the leading parts 94*a* of all the groups 90-1 to 90-n is completed, the controller 10 moves the label medium 90 in the reverse direction, and drives the second cutting mechanism 8 between the leading group 90-1 and the second group 90-2, thereby fully cutting the label medium 90 over the entire width (see (10) in FIG. 30). Sequentially, the controller 10 fully cuts the label medium 90 between the respective groups and finally fully cuts an end of the final group 90-n over the entire width (see (11) in FIG. 30).

According to the processing of the printer 1 as described above, when half-cutting the outline 94 of the frame part 93, the printing of the label parts 91 is also performed. Therefore, it is possible to shorten the overall time after the printing starts until the label medium 90 is discharged. Also, according to the related art, the half-cutting of the outline 94 is performed after the printing of the label parts 91 is over. Thus, the printing is performed so that an extra load other than the load applied to the label medium 90 from the thermal head 3 is not applied as much as possible. However, according to the printer 1, the half-cutting by the cutting tool 7*a* is continuously performed before the start of the printing until the printing is over. Therefore, it is possible to remove the variation in the load and the variation in the feeding speed of the label medium 90 during the printing and to thus prevent an image quality from being deteriorated due to the printing non-uniformity of the label parts 91. Further, the groups 90-1 to 90-n fully cut by the second cutting mechanism 8 are discharged one copy by one copy from the printer 1. Therefore, the user performs the operation of peeling off the frame part 93 from the release sheet 20*d* for each divided group. Accordingly, the user can avoid lowering of the operation efficiency due to the label part 91 being coupled to the frame part 93 and thus peeled off in each divided group.

11. Printer Mode Selection

Figure 27:
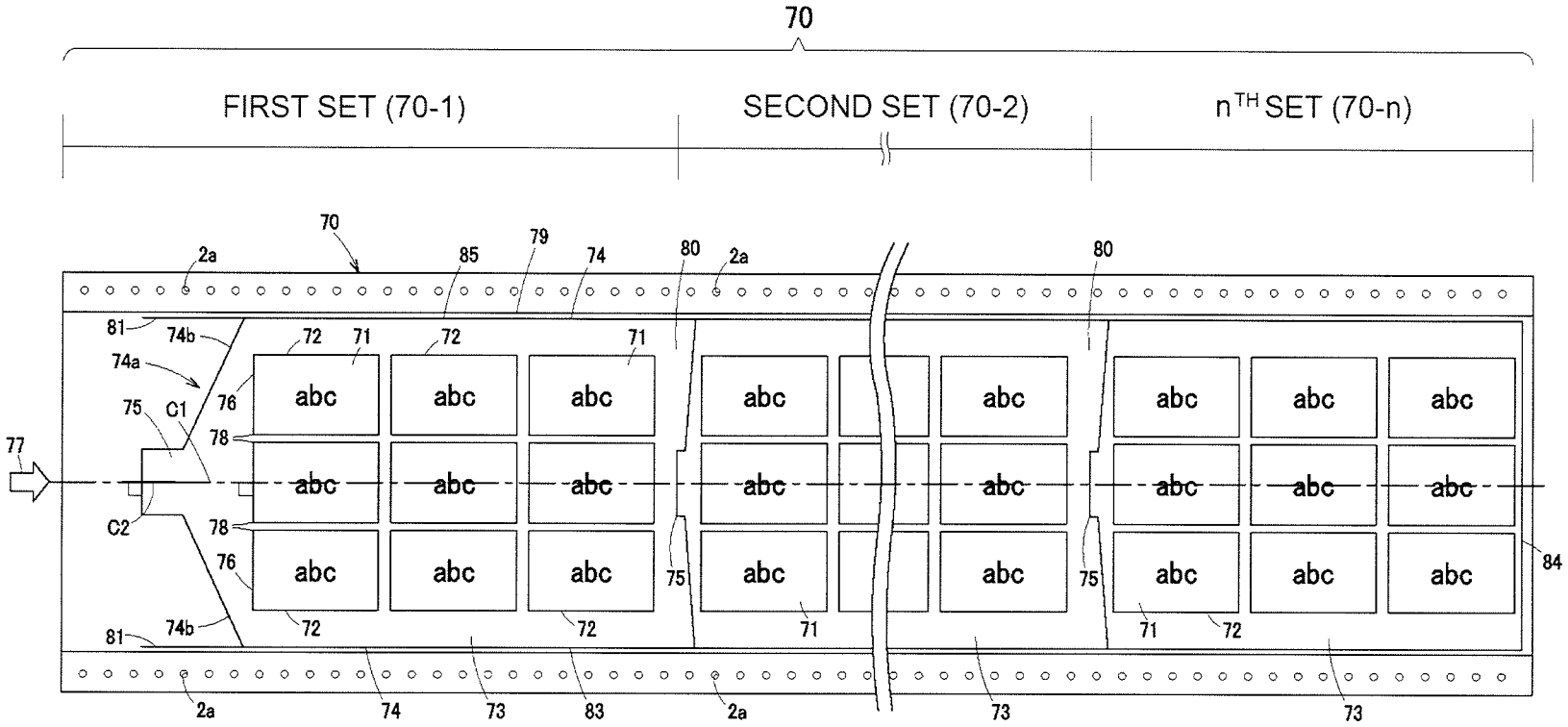
FIG. 27 is a plan view of a twentieth modified example in which copies of a set of label parts are sequentially printed in a longitudinal direction.

As described above, the printer 1 includes a case where the plurality of label parts 21 is printed on the label medium 20 for one group and one copy is discharged, as shown in FIGS. 3, 5, 8 to 24 and the like, and a case where the plurality of label parts is printed for the plurality of groups and is then discharged, as shown in FIGS. 25 and 27 to 29. The case where the plurality of copies is printed includes a case where the plurality of copies is printed on the one label medium 70 and is discharged without being fully cut at the border part of the groups, as shown in FIGS. 25 and 27, and a case where the plurality of copies is printed, is fully cut at the border part of the groups and is then discharged one copy by one copy, as shown in FIGS. 28 and 29.

Figure 31:
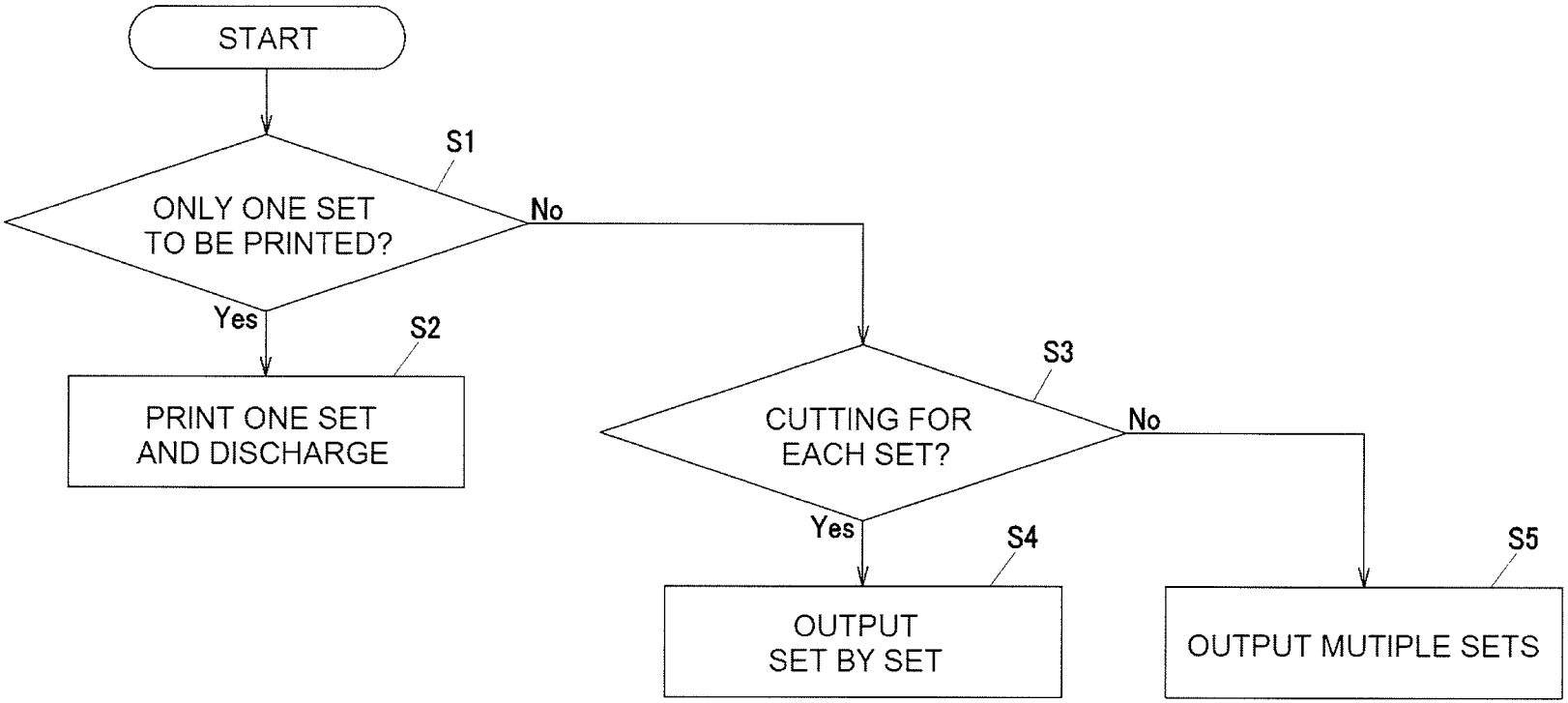
FIG. 31 is a flowchart of a mode selection of the printer.

Therefore, as shown in FIG. 31, in step S1, based on the print data input from the information processing apparatus such as a PC and a workstation, the controller 10 of the printer 1 refers to the input print data to determine whether the number of copies to be printed is one copy. When it is determined that one copy is to be printed, the controller 10 prints the plurality of label parts 21 by one copy in step S2, as shown in FIGS. 3, 5, 8 to 24 and the like. When it is determined that a plurality of copies is to be printed, the controller 10 determines whether or not to discharge the label parts for each copy (for each group) in step S3. The controller 10 makes the determination, depending on whether a command to instruct the discharge of the label parts for each copy is input from any one of the information processing apparatus and an operation unit of the printer 1. When it is determined that the label parts are to be printed for each copy, the controller 10 fully cuts the label medium 90 by the second cutting mechanism 8 one copy by one copy for each group in the width direction of the label medium and discharges the same in step S4, as shown in FIGS. 28 and 29. When outputting the plurality of copies in series, the controller 10 discharges a series of the label medium 70 without fully cutting the label medium 90 for each group in step S5, as shown in FIGS. 25 and 27.

12. Modified Examples of Tab Part

Figure 32A:
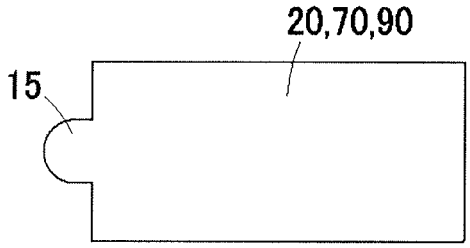
FIGS. 32A to 32E illustrate modified examples of a tab shape.
Figure 32B:
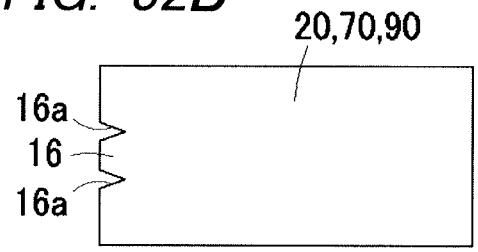
Figure 32C:
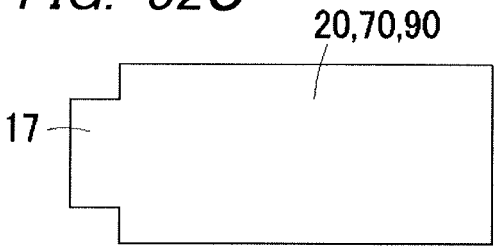
Figure 32D:
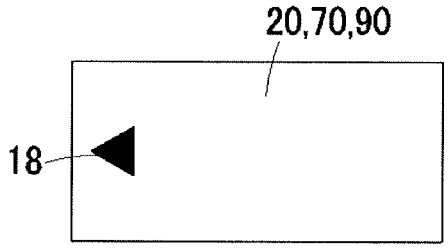
Figure 32E:
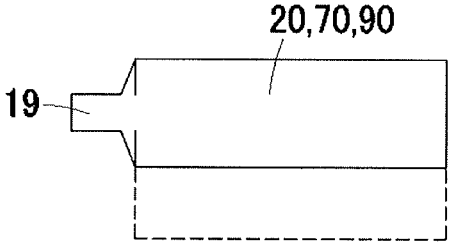
Figure 33:
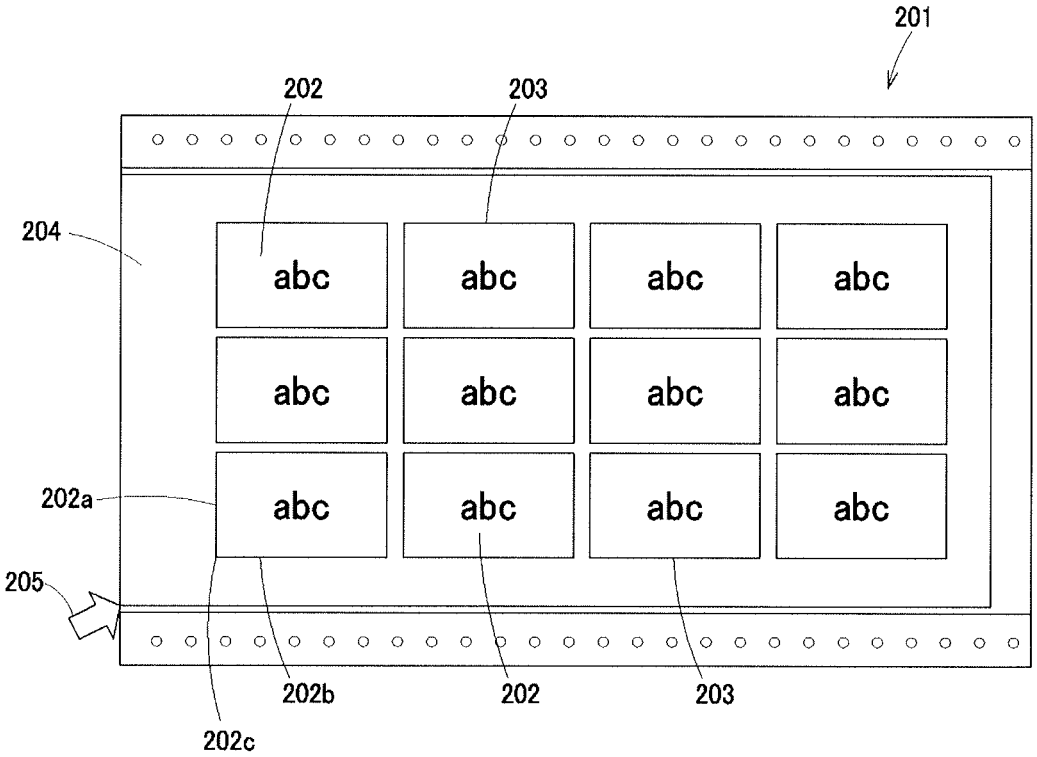
FIG. 33 is a plan view of a label medium according to a related art.

The shape of the tab part of the label medium 20, 70, 90 is not limited to the rectangular shape shown in FIG. 3 and the like. For example, as shown in FIG. 32A, the shape of the tab part may be a tab part 15 having an arc shape. Also, as shown in FIG. 32B, two slits 16*a*, 16*a* are formed inwardly from a side edge of the tip-side of the label medium 20, 70, 90, so that a tab part 16 may be formed between the slits 16*a*, 16*a*. In addition, as shown in FIG. 32C, a wide rectangular tab part 17 may be possible. Also, as shown in FIG. 32D, a printed triangular mark 18 may be possible. Also, the mark 18 may be a punched hole. Further, as shown in FIG. 32E, a position of a tab part 19 may be varied depending on the width of the label medium 70. In this case, the position of the tab part 19 may be adjusted so that the peeling force is applied from a direction substantially perpendicular to a side of the label part facing the tab part by the shape of each label part and the like through the controller 10. The shape of the tab part is not limited to the above examples and may be freely set in accordance with the user operation through the information processing apparatus connected to the printer 1.

13. Other Modified Examples

The printer 1 is not limited to the printer having the thermal head 3, and any printer capable of performing a printing for the label medium 20 is possible. For example, a printer having an inkjet head where an ink is pressed with a pressure generated by a heater or piezoelectric element, the pressed ink is discharged to the label medium 20 from discharge openings in a droplet shape and an image, a letter and the like are printed on the label medium 20 may be also used. Also, an ink ribbon may be a single color. Alternatively, one ribbon field-sequentially provided with dyes such as yellow, cyan, magenta and black may be also used.

What is claimed is:

1. A label manufacturing apparatus configured to form an image on a label medium, the label medium comprising a release sheet and an adhesive sheet temporarily adhered to the release sheet, the adhesive sheet having a base layer and an adhesive layer provided on the base layer, the label manufacturing apparatus comprising:

a feeding mechanism configured to convey the label medium;

a printing head configured to print an image on the base layer to form a plurality of label parts;

a cutting mechanism configured to cut the adhesive sheet along an outline of each of the label parts such that only a frame part which is provided outside the label parts of the label medium is peeled off from the release sheet in a state where the label parts of the adhesive sheet are temporarily adhered to the release sheet, and a controller configured to control the feeding mechanism and the cutting mechanism to form a peeling direction indicating portion on the frame part, the peeling direction indicating portion indicating a peeling direction in which the frame part is peeled off from the release sheet, wherein the peeling direction indicating portion is determined based on a shape of each of the label parts and is formed substantially perpendicular to a leading side of each of the label parts, the leading side of each of the label parts being the side that is positioned closest to the peeling direction indicating portion and that first separates from the frame part when the frame part is peeled off from the release sheet, wherein a central axis extending in the peeling direction and passing through a center of the peeling direction indicating portion in a width direction intersects the leading side of at least one of the label parts, the controller further configured to control the feeding mechanism and the cutting mechanism to form extension lines extending from the frame part toward a leading side of the label medium, wherein the plurality of label parts includes rows and columns of label parts, wherein the frame part is a unitary portion of the adhesive sheet provided outside of the rows and columns of label parts, wherein the peeling direction indication portion is a tab formed on the frame part and extending toward the leading side of the label medium, and wherein the central axis extending in the peeling direction and passing through a center of the peeling direction indicating portion in a width direction passes through a center of the label medium in the width direction.

2. The label manufacturing apparatus according to claim 1, wherein the plurality of label parts comprises a first group of label parts provided in an arrangement and one or more subsequent groups of label parts as copies of the first group, and wherein the controller is configured to sequentially print the first group and the one or more subsequent groups along a longitudinal direction of the label medium, and to provide the peeling direction indicating portion in front of the first group.

3. The label manufacturing apparatus according to claim 2, further comprising an additional cutting mechanism configured to cut the label medium in a width direction of the label medium at a border part between the groups, and wherein the controller is configured to cut the label medium in the width direction at the border part by the additional cutting mechanism.

4. The label manufacturing apparatus according to claim 1, wherein the peeling direction indicating portion is a tab formed continuously with the frame part.

5. The label manufacturing apparatus according to claim 1, wherein the controller is configured to print the label parts by the printing head while cutting the adhesive sheet by the cutting mechanism.

6. The label manufacturing apparatus according to claim 1, wherein the label parts has a polygonal shape, and wherein the one side of each of the label parts having the polygonal shape is closest to the peeling direction indicating portion among all sides of the polygonal shape.

7. The label manufacturing apparatus according to claim 4, wherein the tab has a rectangular shape, and wherein the peeling direction is perpendicular to one side of the rectangular shape of the tab.

8. The label manufacturing apparatus according to claim 7, wherein the one side of the rectangular shape of the tab which is perpendicular to the peeling direction is longer than another side of the rectangular shape of the tab which is in parallel to the peeling direction.

* * * * *